US005853310A

United States Patent [19]

Nishimura et al.

[11] Patent Number: 5,853,310

[45] Date of Patent: Dec. 29, 1998

[54] METHOD OF MANUFACTURING ELECTRON-EMITTING DEVICE, ELECTRON SOURCE AND IMAGE-FORMING APPARATUS

[75] Inventors: Michiyo Nishimura, Sagamihara; Ichiro Nomura, Atsugi; Yoshikazu Banno, Machida; Takeo Tsukamoto, Atsugi; Hirokatsu Miyata, Hadano; Kazuhiro Takada, Atsugi, all of Japan

[73] Assignee: Canon Kabushiki Kaisha, Tokyo, Japan

[21] Appl. No.: 563,768

[22] Filed: Nov. 28, 1995

[30] Foreign Application Priority Data

Nov. 29, 1994 [JP] Japan ..... 6-317796
Nov. 21, 1995 [JP] Japan ..... 7-325279

[51] Int. Cl.[6] ..... H01J 9/02; H01J 1/30

[52] U.S. Cl. ..... 445/1.24; 445/51

[58] Field of Search ..... 445/24, 50, 51

[56] References Cited

U.S. PATENT DOCUMENTS

| | | | |
|---|---|---|---|
| 3,611,077 | 10/1971 | Smith | 315/94 |
| 3,663,857 | 5/1972 | Soellner et al. | 313/339 |
| 4,663,559 | 5/1987 | Christensen | 313/336 |
| 4,890,035 | 12/1989 | Prein et al. | 313/633 |
| 5,066,883 | 11/1991 | Yoshioka et al. | 313/309 |

FOREIGN PATENT DOCUMENTS

| | | | |
|---|---|---|---|
| 0536731 | 4/1993 | European Pat. Off. . | |
| 0658924 | 6/1995 | European Pat. Off. . | |
| 63-298934 | 12/1988 | Japan . | |
| 64-19656 | 1/1989 | Japan | 445/51 |
| 6-231678 | 8/1994 | Japan | 445/51 |

OTHER PUBLICATIONS

W.P. Dyke, et al., "Field Emission", Advances in Electronics and Electron Physics, pp. 89–185, 1956.

C. Mead, "Operation of Tunnel–Emission Devices", Journal of Applied Physics, vol. 32, No. 4, pp. 646–652, 1961.

M. Elinson, et al., "The Emission of Hot Electrons and the Field Emission of Electrons from Tin Oxide", Radio Engineering and Electronic Physics, No. 7, pp. 1290–1296, 1965.

G. Dittmer, "Electrical Conduction and Electron Emission of Discontinuous Thin Films", Thin Solid Films, 9, pp. 317–328, 1972.

M. Hartwell, et al., "Strong Electron Emission From Patterned Tin–Indium Oxide Thin Films", Int'l Electron Devices Meeting, pp. 519–521, 1975.

C. Spindt, et al., "Physical Properties of Thin–Film Field Emission Cathodes with Molybdenum Cones", Journal of Applied Physics, vol. 47, No. 12, pp. 5248–5263, 1976.

H. Araki, et al., "Electroforming and Electron Emission of Carbide Thin Films", Journal of the Vacuum Society of Japan, vol. 26, No. 1, pp. 22–29, 1983.

*Primary Examiner*—Patrick Ryan
*Assistant Examiner*—Jeffrey T. Knapp
*Attorney, Agent, or Firm*—Fitzpatrick, Cella, Harper & Scinto

[57] ABSTRACT

A method of manufacturing an electron-emitting device includes providing a pair of electrodes and an electroconductive thin film arranged between the electrodes. The method also includes a step of forming an electron-emitting region in the electroconductive film by the steps of partially modifying the composition of the electroconductive thin film with a chemical change to make a region of the electroconductive thin film have a higher resistivity than a resistivity in other regions, and causing an electric current to run through the electroconductive thin film to form the electron-emitting region in the region having the higher resistivity.

26 Claims, 19 Drawing Sheets

METHOD OF MANUFACTURING ELECTRON-EMITTING DEVICE, ELECTRON SOURCE AND IMAGE-FORMING APPARATUS

BACKGROUND OF THE INVENTION

1. Field of the Invention

This invention relates to a method of manufacturing an electron-emitting device as well as a method of manufacturing an electron source and an image-forming apparatus, using such electron-emitting devices.

2. Related Background Art

There have been known two types of electron-emitting devices; the thermoelectron emission type and the cold cathode electron emission type. Of these, the cold cathode emission type refers to devices including field emission type (hereinafter referred to as the FE type) devices, metal/insulation layer/metal type (hereinafter referred to as the MIM type) electron-emitting devices and surface conduction electron-emitting devices. Examples of FE type device include those proposed by W. P. Dyke & W. W. Dolan, "Field Emission", Advance in Electron Physics, Vol. 8, 89–185 (1956) and C. A. Spindt, "Physical properties of thin-film field emission cathodes with molybdenum cones", J. Appl. Phys., 47, 5248 (1976).

Examples of MIM device are disclosed in papers including C. A. Mead, "The tunnel-emission amplifier", J. Appl. Phys., 32, 646 (1961).

Examples of surface conduction electron-emitting device include one proposed by M. I. Elinson, Radio Eng. Electron Phys., 10 (1965).

A surface conduction electron-emitting device is realized by utilizing the phenomenon that electrons are emitted out of a small thin film formed on a substrate when an electric current is forced to flow in parallel with the film surface. While Elinson proposes the use of $SnO_2$ thin film for a device of this type, the use of Au thin film is proposed in [G. Dittmer: "Thin Solid Films", 9, 317 (1972)] whereas the use of $In_2O_3/SnO_2$ and that of carbon thin film are discussed respectively in [M. Hartwell and C. G. Fonstad: "IEEE Trans. ED Conf.", 519 (1975)] and [H. Araki et al.: "Vacuum", Vol. 26, No. 1, p. 22 (1983)].

FIG. 23 of the accompanying drawings schematically illustrates a typical surface conduction electron-emitting device proposed by M. Hartwell. In FIG. 23, reference numeral 1 denotes a substrate. Reference numeral 3 denotes an electroconductive thin film normally prepared by producing an H-shaped thin metal oxide film by means of sputtering, part of which eventually makes an electron-emitting region 2 when it is subjected to an electrically energizing process referred to as "energization-forming" as described hereinafter. In FIG. 23, the thin horizontal area of the metal oxide film separating a pair of device electrodes has a length L of 0.5 to 1 mm and a width W' of 0.1 mm.

Conventionally, an electron-emitting region 2 is produced in a surface conduction electron-emitting device by subjecting the electroconductive thin film 3 of the device to an electrically energizing preliminary process, which is referred to as "energization forming". In the energization forming process, a constant DC voltage or a slowly rising DC voltage that rises typically at a rate of 1V/min. is applied to given opposite ends of the electroconductive thin film 3 to partly destroy, deform or transform the film and produce an electron-emitting region 2 which is electrically highly resistive. Therefore, the electron-emitting region 2 is part of the electroconductive thin film 3 that typically contains a fissure or fissures therein so that electrons may be emitted from the fissure. Thus, when a voltage is applied to the electroconductive thin film 3 of a surface conduction electron-emitting device that has been subjected to an energization forming process, the electron-emitting region 2 emits electrons.

On the other hand, with the above described known energization forming process, it is difficult to precisely control the position and the profile of the electron-emitting region to be formed in the electroconductive thin film and, therefore, to produce electron-emitting devices that uniformly operate for electron emission. Thus, an electron source realized by arranging a number of such electron-emitting devices and an image-forming apparatus comprising such an electron source can show a remarkable unevenness in the performance of electron emission and hence the brightness of the image display screen.

SUMMARY OF THE INVENTION

In view of the above identified problem, it is therefore the object of the invention to provide an improved method of manufacturing an electron-emitting device comprising a step of subjecting an electroconductive thin film to an energization forming process to produce an electron-emitting region in the electroconductive thin film that can control the position and the profile of the electron-emitting region as well as a method of manufacturing a high quality electron source by arranging a number of such electron-emitting devices on a substrate and an image-forming apparatus comprising such an electron source and an image-forming member.

According to the invention, the above object is achieved by providing a method of manufacturing an electron-emitting device comprising a pair of electrodes and an electroconductive thin film including an electron-emitting region arranged between the electrodes characterized in that the electron-emitting region is formed by steps of modifying the composition of a region of the electroconductive thin film and causing an electric current to run through the electroconductive thin film.

Preferably, the step of modifying the composition of a region of the electroconductive thin film is a step of forming a region of a metal and another region of an oxide of the metal in the electroconductive thin film.

In a preferred mode of carrying out the invention, the step of modifying the composition of a region of the electroconductive thin film includes a step of oxidizing part of a region of a metal in the electroconductive thin film.

In another preferred mode of carrying out the invention, the step of modifying the composition of a region of the electroconductive thin film includes a step of reducing part of a region of a metal oxide in the electroconductive thin film.

In still another preferred mode of carrying out the invention, the step of modifying the composition of a region of the electroconductive thin film includes a step of forming a region of a metal and another region of an oxide of the metal in a film made of an organic metal compound.

In still another preferred mode of carrying out the invention, the step of modifying the composition of a region of the electroconductive thin film includes a step of forming a region of a mixture of a metal and a semiconductor and another region of a mixture of an oxide of the metal and the semiconductor.

In still another preferred mode of carrying out the invention, the step of modifying the composition of a region of the electroconductive thin film includes a step of oxidizing part of a region of a mixture of a metal and a semiconductor in the electroconductive thin film.

In still another preferred mode of carrying out the invention, the step of modifying the composition of a region of the electroconductive thin film includes a step of reducing part of a region of a mixture of a metal oxide and a semiconductor in the electroconductive thin film.

In still another preferred mode of carrying out the invention, the step of modifying the composition of a region of the electroconductive thin film includes a step of forming a region of a metal and another region of a nitride of the metal.

In still another preferred mode of carrying out the invention, the step of modifying the composition of a region of the electroconductive thin film includes a step of nitriding part of a region of a metal in the electroconductive thin film.

DETAILED DESCRIPTION OF THE PREFERRED EMBODIMENTS

In the so-called energization forming process for electrically energizing the electroconductive thin film of an electron-emitting device to produce an electron-emitting region in the electroconductive thin film, while the site where a qualitative change and/or a physical deformation take place in the electroconductive thin film is determined as a function of a number of different factors, it is important to know the site where shows a large temperature rise as a result of generation of Joule's heat.

If the electroconductive thin film is evenly formed and the device electrodes are highly symmetrically arranged, Joule's heat is supposed to be generated evenly throughout the film and no such a site may be existent. If the conduction of heat to the surrounding areas is taken into consideration, it may be safe to assume that such a site is located at the middle of the two electrodes. However, this is not necessarily always true because the electroconductive thin film is typically not evenly formed for a number of reasons and, among others, because the electrodes are not satisfactorily symmetrically formed particularly if they are produced by printing as compared with a case where they are prepared by photolithography. In addition, the operation of forming as an electrically highly resistive portion in the film to produce an electron-emitting region there involves a complicated process of physically deforming and qualitatively changing part of the electroconductive thin film to make it electrically highly resistive, which by turn changes the distribution of electric current running therethrough. As a result, the electron-emitting region can come to show a greatly swerving profile if there exist any disturbing elements in the environment. It is difficult to control the performance of an electron-emitting device having such a distorted electron-emitting region and, therefore, an electron source prepared by arranging a number of electron-emitting devices that are hardly controllable for the electron-emitting performance and an image-forming apparatus incorporating such an electron source can show a remarkable unevenness in the performance of electron emission and hence the brightness of the image display screen.

Figure 2A:
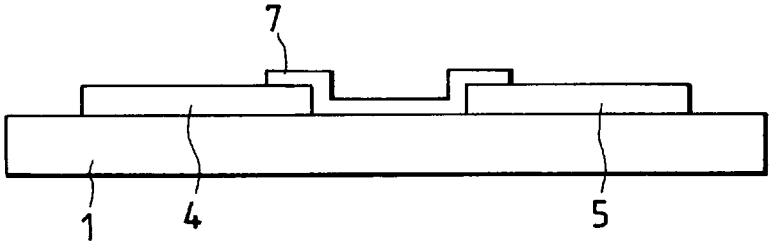
FIGS. 2A through 2C are schematic sectional views of the surface conduction electron-emitting device, showing it in different manufacturing steps.
Figure 2B:
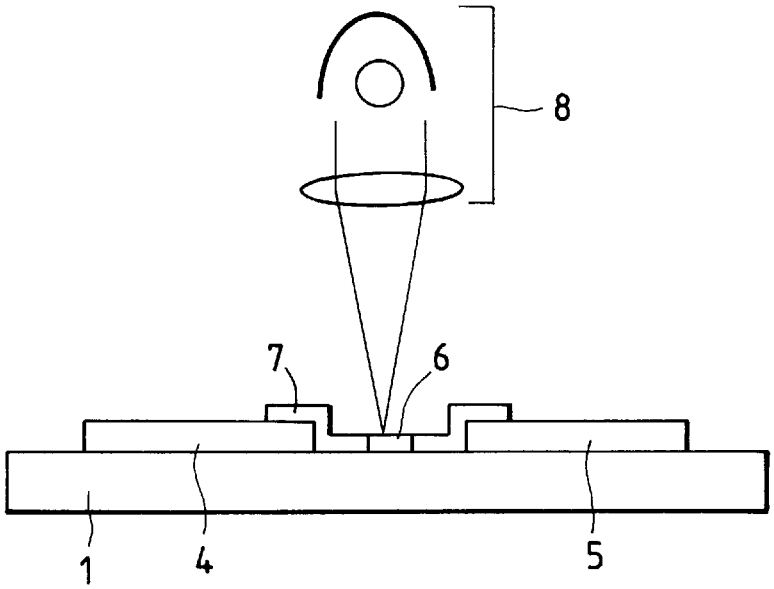
Figure 2C:
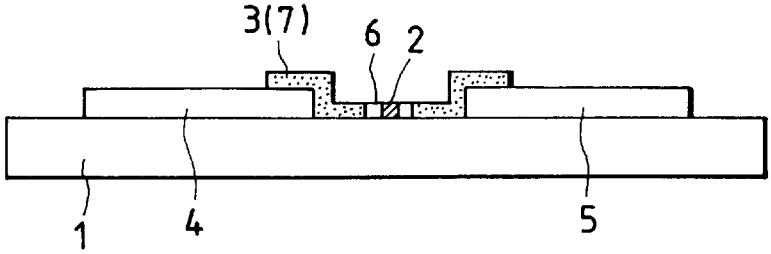

In view of these problems, according to the invention, there is provided a method of manufacturing an electron-emitting device comprising a pair of electrodes and an electroconductive thin film including an electron-emitting region arranged between the electrodes, characterized in that the electron-emitting region is formed, as shown in FIGS. 2A through 2C, by (1) a step of modifying the composition of a region of the electroconductive thin film (for forming the electron-emitting region) 7 arranged between the electrodes 4, 5 on a substrate 1 (FIGS. 2A and 2B) in such a way that the composition of the region for making the electron-emitting region and that of the remaining region of the electroconductive thin film 7 are differentiated from each other in order to form in the former region a latent image 6 for the electron-emitting region, which generates an electric field stronger than the remaining region or in which the electric field is more concentrated than in the remaining region when a voltage is applied to the device electrodes 4, 5, and (2) a step of causing an electric current to run through said electroconductive thin film (FIG. 2C) by, for example, applying a voltage to the thin film 7 for forming the electron-emitting region in order to locally heat the latent image 6 for the electron-emitting region and consequently produce the electron-emitting region 2 there.

As seen from above, in order to cause the electric field in the region for making an electron-emitting region to become more concentrated than in the remaining region, it is necessary to make the electric resistance per unit length of that region sufficiently larger than that of the remaining region. The electric resistance per unit length of that region is determined by the ratio of the electric resistivity of the composition and the thickness of that region. If the film thickness of that region is not remarkably different from that of the remaining region, the electric resistivity of the composition of that region has to be made sufficiently large.

For instance, such differentiation of electric resistivity can be realized if the region other than the latent image for the electron-emitting region 7 is made of a metal and the region of the latent image is made of an oxide or nitride of the metal when the step (1) is completed. The step (1) can be carried out, for example, by locally oxidizing or nitriding a metal film in the region where a latent image is to be formed or by reducing a metal oxide film to produce a metal film in the region other than the region where a latent image is to be formed. Alternatively, the step can be carried out by decomposing an organic metal compound film to differentiate the condition of the region where a latent image is to be formed and that of the remaining region in order to turn the latent image region to a metal oxide while the remaining region is turned to a metal.

A technique that can be used for local oxidation or nitridation for the purpose of the present invention is to locally heat the thin film for forming an electron-emitting region and cause it to chemically react in the ambient air or in an appropriate atmosphere containing oxygen or ammonia gas. More specifically, the thin film for forming an electron-emitting region can be locally heated by scanning a desired area thereof with a laser beam spot or by applying a relatively low voltage to the thin film for forming an electron-emitting region to heat it in such a way that the region where a latent image is to be formed is made particularly hot. Alternatively, the chemical reaction in the thin film for forming an electron-emitting region may be locally accelerated by means of UV rays.

With a technique for chemically reducing the material of the region other than the region where a latent image is to be formed, a metal oxide film is heated in the region other than the region where a latent image to be formed. For this technique to be effective, the heating should be conducted in an atmosphere that can reduce the metal compound by heat. The atmosphere to be selected can vary depending on the metal compound used for the electroconductive thin film. Alternatively, the metal oxide can be reduced by irradiating it with electron beams in vacuum.

Alternatively, differentiation of electric resistivity can be realized between the region where a latent image is to be formed for the electron-emitting region and the remaining region if the latter region is made of a mixture of a metal and a semiconductor and the former region is made of a mixture of an oxide of the metal and a semiconductor when the step (1) is completed.

"Semiconductors" for the purpose of the invention include not only those that can be used for semiconductor devices such as Si and GaAs but also those having an appropriate electric resistivity such as $SnO_2$ and $In_2O_3$. While these are metal oxides themselves, they should be chemically more stable than the metal oxide to be used with them. For instance, if heated, $Ag_2O$ is easily decomposed to produce metal Ag, whereas $SnO_2$ and $In_2O_3$ are not chemically changed.

The techniques described earlier for oxidation and reduction can also be used for mixtures as described above.

As the step (2) is carried out after forming a latent image, Joule's heat is generated more intensely in the region of the latent image where the electric field is concentrated than in the remaining region so that an electron-emitting region is formed for certain in the region of the latent image. Thus, if the position and the profile of the electron-emitting region can be controlled regardless of the distance separating the device electrodes and their shapes only if the position and the profile of the region of the latent image are controlled.

It should be noted here that some of the techniques described above for the step (1) can be used in the air, in these cases, a subsequent step (3) can be carried out also in the air, and many of the remaining techniques can be used in an atmosphere of different gases (inert gas, reducing gas, nitriding gas and so on) having a pressure of 1 atm. In other words, this step does not require the use of a vacuum apparatus to provide an advantage in the manufacture of an electron-emitting device.

In addition to the above two steps, a step of reducing the entire electroconductive thin film may be introduced after the formation of the electron-emitting region in order to reduce the electric resistivity of any remaining high resistivity regions of the electroconductive thin film. In such a step, the entire device may be heated in an atmosphere containing $H_2$. Then, the latent image for making an electron-emitting region finally disappears from the device.

Now, a method of manufacturing a surface conduction electron-emitting device according to the invention will be described.

Figure 1A:
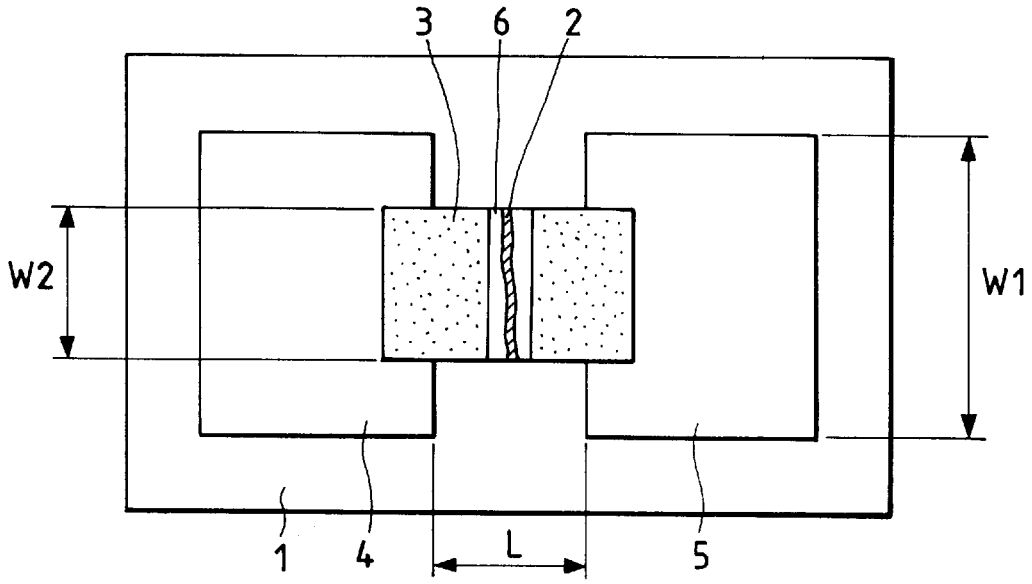
FIGS. 1A and 1B are schematic views of a surface conduction electron-emitting prepared by a method according to the invention, showing the basic configuration thereof.
Figure 1B:
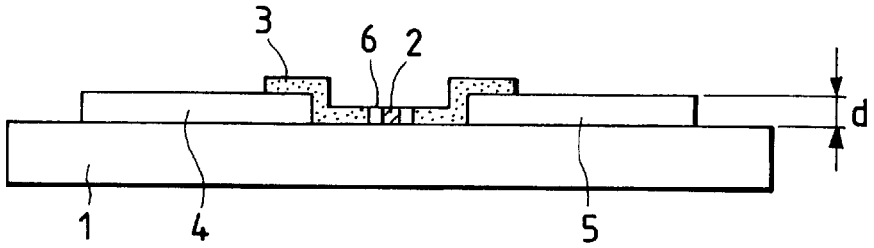

FIGS. 1A and 1B are schematic views of a surface conduction electron-emitting device of an electron source according to the invention, of which FIG. 1A is a plan view and FIG. 1B is cross sectional view.

Referring to FIGS. 1A and 1B, there are shown a substrate 1, a pair of device electrodes 4 and 5, an electroconductive thin film 3 and an electron-emitting region on 2.

Materials that can be used for the substrate 1 include quartz glass, glass containing impurities such as Na to a reduced concentration level, soda lime glass, glass substrate realized by forming an $SiO_2$ layer on soda lime glass by means of sputtering, ceramic substances such as alumina as well as Si.

While the oppositely arranged device electrodes 4 and 5 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, $RuO_2$, Pd—Ag and glass, transparent conducting materials such as $In_2O_3$—$SnO_2$ and semiconductor materials such as polysilicon.

The distance L separating the device electrodes, the lengths W1 of the device electrodes, the width W2 of the electroconductive thin film and other factors for designing a surface conduction electron-emitting device according to the invention may be determined depending on the application of the device. The. distance L separating the device electrodes 4 and 5 is preferably between several hundred nanometers and several hundred micrometers and, still preferably, between several micrometers and tens of several micrometers.

The length W1 of the device electrodes is preferably between several micrometers and hundreds of several micrometers depending on the resistance of the electrodes and the electron-emitting characteristics of the device. The film thickness d of the device electrodes 4 and 5 is between tens of several nanometers and several micrometers.

A surface conduction electron-emitting device that can be used for the purpose of the present invention may have a configuration other than the one illustrated in FIGS. 1A and 1B and, alternatively, it may be prepared by laying an electroconductive thin film 3 and subsequently a pair of oppositely disposed device electrodes 4 and 5 on the substrate 1.

The electroconductive thin film 3 is preferably a fine particle film in order to provide excellent electron-emitting characteristics. The thickness of the electroconductive thin film 3 is determined as a function of the stepped coverage of the electroconductive thin film on the device electrodes 4 and 5, the electric resistance between the device electrodes 4 and 5 and the parameters for the forming operation that will be described later as well as other factors and preferably between a tenth of a nanometer and hundreds of several nanometers and more preferably between a nanometer and fifty nanometers. The electroconductive thin film 3 normally shows a resistance Rs between $10^2$ and $10^7$/square. Note that Rs is the resistance defined by R=Rs(1/w), where t, w and l are the thickness, the width and the length of the thin film respectively. R is a resistance of a film measuring along a direction of the length 1.

The term a "fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between a tenth of a nanometer and hundreds of several nanometers and preferably between a nanometer and twenty nanometers.

Since the term "fine particle" is frequently used herein, it will be described in greater depth below.

A small particle is referred to as a "fine particle" and a particle smaller than a fine particle is referred to as an "ultrafine particle". A particle smaller than an "ultrafine particle" and constituted by several hundred atoms is referred to as a "cluster".

However, these definitions are not rigorous and the scope of each term can vary depending on the particular aspect of the particle to be dealt with. An "ultrafine particle" may be referred to simply as a "fine particle" as in the case of this patent application.

"The Experimental Physics Course No. 14: Surface/Fine Particle" (ed., Koreo Kinoshita; Kyoritu Publication, Sep. 1, 1986) describes as follows.

"A fine particle as used herein refers to a particle having a diameter somewhere between 2 to 3 $\mu$m and 10 nm and an ultrafine particle as used herein means a particles having a diameter somewhere between 10 nm and 2 to 3 nm. However, these definitions are by no means rigorous and an ultrafine particle may also be referred to simply as a fine particle. Therefore, these definitions are a rule of thumb in any means. A particle constituted of two to several hundred atoms is called a "cluster." (Ibid., p.195, 11.22–26)

Additionally, "Hayashi's Ultrafine Particle Project" of the New Technology Development Corporation defines an "ultrafine particle" as follows, employing a smaller lower limit for the particle size.

"The Ultrafine Particle Project (1981–1986) under the Creative Science and Technology Promoting Scheme defines an ultrafine particle as a particle having a diameter between about 1 and 100 nm. This means an ultrafine particle is an agglomerate of about 100 to $10^8$ atoms. From the viewpoint of atom, an ultrafine particle is a huge or ultrahuge particle." (Ultrafine Particle—Creative Science and Technology: ed., Chikara Hayashi, Ryoji Ueda, Akira Tazaki; Mita Publication, 1988, p.2, 11.1–4) "A particle smaller than an ultrafine particle formed by several to several hundred atoms is generally called a cluster." (Ibid: page 2, pp.12–13)

Taking the above general definitions into consideration, the term a "fine particle" as used herein refers to an agglomerate of a large number of atoms and/or molecules having a diameter with a lower limit between 0.1 nm and 1 nm and an upper limit of several micrometers.

An electroconductive thin film for forming an electroconductive thin film including an electron-emitting region before the electron-emitting region is actually completed will be hereinafter referred to as "thin film 7 for forming an electron-emitting region" in order to avoid confusion. When the above described step (1) is completed, a thin film for forming an electron-emitting region includes a region typically of a metal having a low electric resistance and a region of an oxide or nitride of the metal having a high electric resistance (latent image for making an electron-emitting region). The metal should be such that its oxide or nitride shows a high electric resistance and can be chemically changed with ease. Specific examples include Pd, Ru, Ag, Au, Ti, In, Cu, Cr, Fe, Zn, Sn, Ta, W and Pb. Any of these metals may be used also as a mixture of its oxide/nitride and a semiconductor. Preferred examples include oxide semiconductors such as $In_2O_3$ and $SnO_2$ and semiconductors such as Si and Ge.

The electron-emitting region 2 is part of the electroconductive thin film 3 and comprises an electrically highly resistive fissure, although its performance is dependent on the thickness and the material of the electroconductive thin film 3 and the energization forming process which will be described hereinafter. The electron-emitting region 2 may contain in the inside electroconductive fine particles having a diameter between several times of a tenth of a nanometer and tens of several nanometers. The material of such electroconductive fine particles may be selected from all or part of the materials that can be used to prepare the thin film 3 including the electron-emitting region. The electron-emitting region 2 and part of the electroconductive thin film 3 surrounding the electron-emitting region 2 may contain carbon and carbon compounds.

Now, a method of manufacturing a surface conduction electron-emitting device having a configuration as shown in FIGS. 1A and 1B according to the invention will be described by referring to FIGS. 2A through 2C. Note that Steps a through c below correspond to FIGS. 2A through 2C respectively.

Step a: In the first step of manufacturing a surface conduction electron-emitting device according to the invention, a thin film 7 for forming an electron-emitting region is prepared from a metal between a pair of oppositely disposed device electrodes 4, 5 that are arranged on an insulating substrate 1 by means of a vacuum film forming technique such as vacuum deposition or sputtering, a vapor growth technique such as CVD or an application technique.

Step b: In the second step of manufacturing a surface conduction electron-emitting device according to the invention, a region 6 for making an electron-emitting region having an electric resistance higher than that of the remaining region is produced by locally irradiating a desired region (in most cases, a substantially central and linearly defined region between the device electrode) of the thin film 7 for forming an electron-emitting region with light and changing the chemical composition of that region. The device is heated and the atmosphere is controlled if necessary. For local irradiation of light, an infrared lamp, an ultraviolet lamp or a laser of some form is used as a light source and the emitted light is converged by means of an appropriate optical system 8 so that a desired region of the device is scanned by the converged light. Said change in the chemical composition may be oxidation, nitridation or some other phase transition of the metal of the thin film.

Figure 3A:
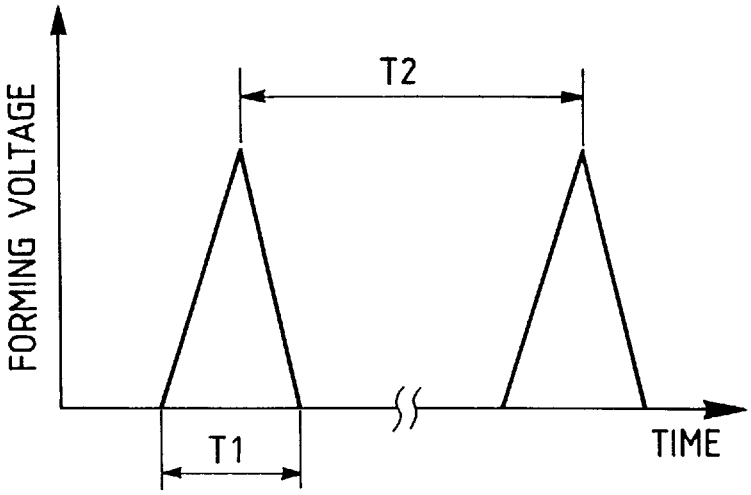
FIGS. 3A and 3B are graphs schematically showing voltage waveforms that can be used for energization forming for the purpose of the invention.
Figure 3B:
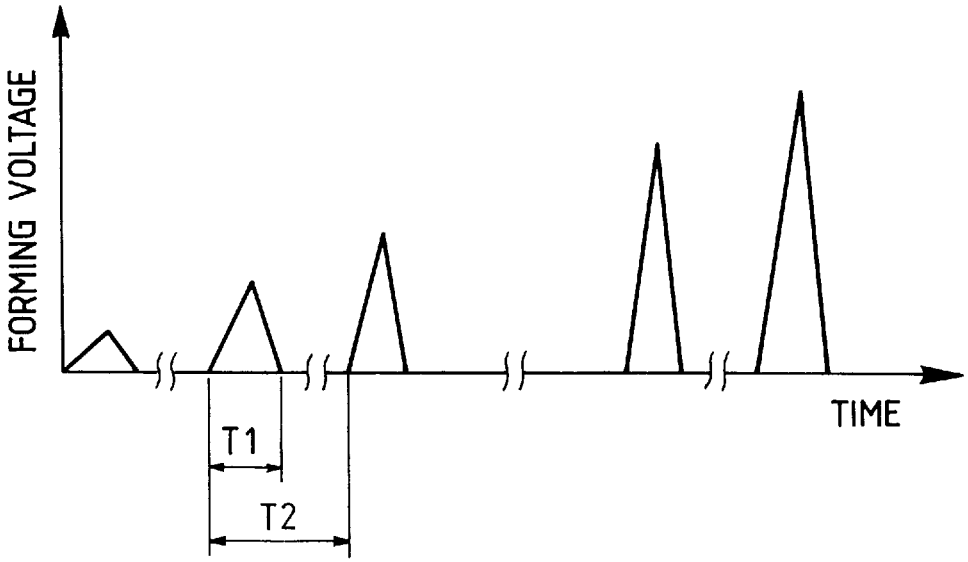

Step c: In the third step of manufacturing a surface conduction electron-emitting device according to the invention, the device electroconductive film 3 between the device electrodes 4 and 5 are subjected to an electrically energizing process referred to as "forming". More specifically, as the electroconductive film 3 between the device electrodes 4 and 5 are electrically energized by means of a power source (not shown), a substantially unswerved electron-emitting region 2 that is well controlled for position and profile is produced in the region 6 for making an electron-emitting region having a high electric resistance in the thin film 7 for forming an electron-emitting region. In other words, the region 6 for making an electron-emitting region is locally and structurally destroyed, deformed or transformed to produce an electron-emitting region 2 as a result of an energization forming process. FIGS. 3A and 3B show two different pulse voltages that can be used for energization forming.

The voltage to be used for energization forming preferably has a pulse waveform. A pulse voltage having a constant wave height or a constant peak voltage may be applied continuously (FIG. 3A) or, alternatively, a pulse voltage having an increasing wave height or an increasing peak voltage may be applied (FIG. 3B).

When a pulse voltage having a constant wave height is used, referring to FIG. 3A, the pulse voltage has a pulse width T1 and a pulse interval T2, which are typically between 1 $\mu$sec. and 10 msec. and between 10 $\mu$sec. and 100 msec. respectively. The height of the triangular wave (the peak voltage for the energization forming operation) may be appropriately selected depending on the profile of the surface conduction electron-emitting device. The voltage is typically applied for several to tens of several minutes in vacuum of an appropriate degree. Note, however, that the pulse waveform is not limited to triangular and a rectangular or some other waveform may alternatively be used.

When a pulse voltage whose pulse height increases with time is used, referring to FIG. 3B, the pulse voltage has a width T1 and a pulse interval T2 that are substantially similar to those of FIG. 3A. The pulse voltage is applied in vacuum of an appropriate degree as in the case of FIG. 3A, increasing the height of the triangular wave (the peak voltage for the energization forming operation) at a rate of, for instance, 0.1V per step.

The energization forming operation will be terminated by measuring the current running through the electroconductive film between the device electrodes with applying a pulse voltage that is sufficiently low and cannot locally destroy or deform the region 6 for making an electron-emitting region between the device electrodes during an interval T2 of the pulse voltage for energization forming, and detecting a resistance of the device. Typically the energization forming operation is terminated when a resistance greater than 1M ohms is observed for the device current while applying a voltage of approximately 0.1V to the device electrodes.

After the energization forming operation, the device is subjected to an activation process. An activation process is a process by means of which the device current If and the emission current Ie are changed remarkably.

In an activation process, a pulse voltage may be repeatedly applied to the device in an atmosphere of the gas of an organic substance as in the case of energization forming process. The atmosphere may be produced by utilizing the organic gas remaining in a vacuum chamber after evacuating the chamber by means of an oil diffusion pump and a rotary pump or by sufficiently evacuating a vacuum chamber by means of an ion pump and thereafter introducing the gas of an organic substance into the vacuum. The gas pressure of the organic substance is determined as a function of the profile of the electron-emitting device to be treated, the profile of the vacuum chamber, the type of the organic substance and other factors. Organic substances that can be suitably used for the purpose of the activation process include aliphatic hydrocarbons such as alkanes, alkenes and alkynes, aromatic hydrocarbons, alcohols, aldehydes, ketones, amines, organic acids such as, phenol, carbonic acids and sulfonic acids. Specific examples include saturated hydrocarbons expressed by general formula $C_nH_{2n+2}$ such as methane, ethane and propane, unsaturated hydrocarbons expressed by general formula $C_nH_{2n}$ such as ethylene and propylene, benzene, toluene, methanol, ethanol, formaldehyde, acetaldehyde, acetone, methylethylketone, methylamine, ethylamine, phenol, formic acid, acetic acid and propionic acid. As a result of an activation process, carbon or a carbon compound is deposited on the device out of the organic substances existing in the atmosphere to remarkably change the device current If and the emission current Ie.

The completion of an activation process is determined by observing the device current If and the emission current Ie. The pulse width, the pulse interval and the pulse wave height should be selected appropriately.

For the purpose of the present invention, carbon and a carbon compound refer to graphite (including so-called HOPG, PG and GC, of which HOPG has a substantially perfect crystal structure, PG has a somewhat distorted crystal structure containing crystalline particles with a size of about 20 nm and GC has a more distorted crystal structure containing crystalline particles with a size of about 2 nm) and carbon (amorphous carbon, a mixture of amorphous carbon and fine graphite crystal) and the thickness of the deposit of such carbon or a carbon compound is preferably less than 50 nm and more preferably less than 30 nm.

An activation process is typically conducted in a manner as described below.

An electron-emitting device obtained after the above steps is then preferably subjected to a stabilization process. This is a process for removing any organic substances remaining in the vacuum chamber. The vacuuming and exhausting equipment to be used for this process preferably does not involve the use of oil so that it may not produce any evaporated oil that can adversely affect the performance of the treated device during the process. Thus, the use of a sorption pump and an ion pump may be a preferable choice.

If an oil diffusion pump and a rotary pump is used for the activation process and the organic gas produced by the oil is also utilized, the partial pressure of the organic gas has to be minimized by any means. The partial pressure of the organic gas in the vacuum chamber is preferably lower than $1.3\times10^{-6}$ Pa and more preferably lower than $1.3\times10^{-8}$ Pa if no carbon or carbon compound is additionally deposited. The vacuum chamber is preferably evacuated after heating the entire chamber so that organic molecules adsorbed by the inner walls of the vacuum chamber and the electron-emitting device in the chamber may also be easily eliminated. While the vacuum chamber is heated to 80° to 250° C., preferably above 150° C., for a period as long as possible, other heating conditions may alternatively be selected depending on the size and the profile of the vacuum chamber and the configuration of the electron-emitting device in the chamber as well as other considerations. The pressure in the vacuum chamber needs to be made as low as possible and it is preferably lower than $1\times10^{-5}$ Pa and more preferably lower than $1.3\times10^{6}$ Pa.

After the stabilization process, the atmosphere for driving the electron-emitting device or the electron source is preferably same as the one when the stabilization process is completed, although a lower pressure may alternatively be used without damaging the stability of operation of the electron-emitting device or the electron source if the organic substances in the chamber are sufficiently removed.

By using such an atmosphere, the formation of any additional deposit of carbon or a carbon compound can be effectively suppressed and $H_2O$, $O_2$ and other substances that have been absorbed by the vacuum chamber and the substrate can be eliminated to consequently stabilize the device current If and the emission current Ie.

The performance of an electron-emitting device prepared by way of the above processes, to which the present invention is applicable, will be described by referring to FIGS. 4 and 5.

Figure 4:
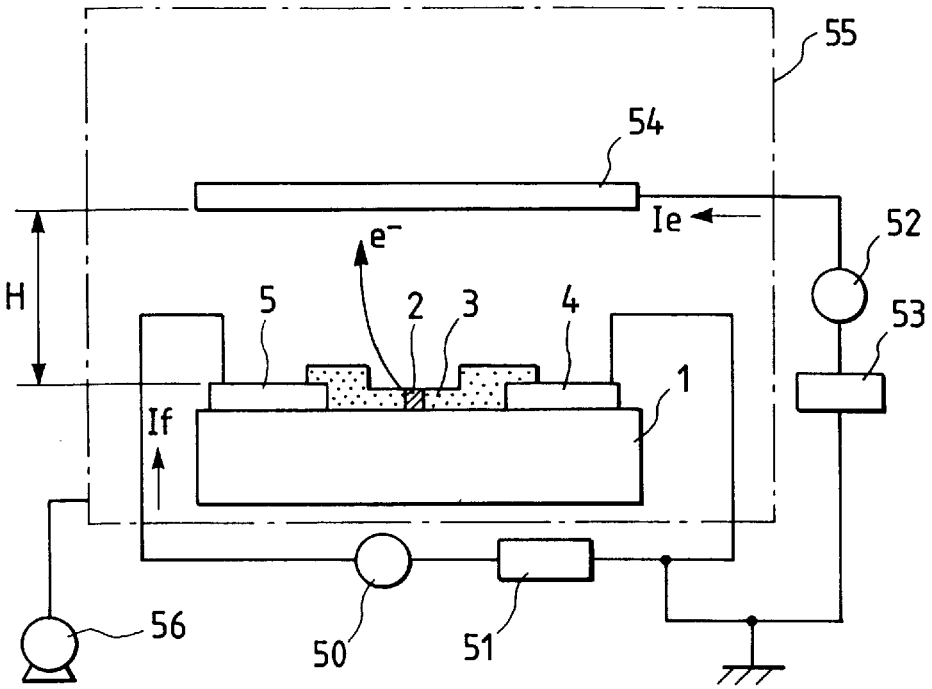
FIG. 4 is a schematic circuit diagram of a gauging system that can be used for determining the electron-emitting performance of a surface conduction electron-emitting device prepared by a method according to the invention.

FIG. 4 is a schematic block diagram of an arrangement comprising a vacuum chamber that can be used for the above processes. It can also be used as a gauging system for determining the performance of an electron-emitting device of the type under consideration. In FIG. 4, the components same as those of FIGS. 1A and 1B are denoted by the same reference symbols respectively. Referring to FIG. 4, the gauging system includes a vacuum chamber 55 and a vacuum pump 56. An electron-emitting device is placed in the vacuum chamber 55. The device comprises a substrate 1, a pair of device electrodes 4 and 5, an electroconductive thin film 3 and an electron-emitting region 2. Otherwise, the gauging system has a power source 51 for applying a device voltage Vf to the device, an ammeter 50 for metering the device current If running through the thin film 3 between the device electrodes 4 and 5, an anode 54 for capturing the emission current Ie produced by electrons emitted from the electron-emitting region of the device, a high voltage source 53 for applying a voltage to the anode 54 of the gauging system and another ammeter 52 for metering the emission current Ie produced by electrons emitted from the electron-emitting region 2 of the device. For determining the performance of the electron-emitting device, a voltage between 1 and 10 KV may be applied to the anode, which is spaced apart from the electron emitting-device by distance H which is between 2 and 8 mm.

Instruments including a vacuum gauge and other pieces of equipment necessary for the gauging system are arranged in the vacuum chamber 55 so that the performance of the electron-emitting device or the electron source in the chamber may be properly tested. The vacuum pump 56 may be provided with an ordinary high vacuum system comprising a turbo pump or a rotary pump or an oil-free high vacuum system comprising an oil-free pump such as a magnetic levitation turbo pump or a dry pump and an ultra-high vacuum system comprising an ion pump. The vacuum chamber containing an electron source therein can be heated to 250° C. by means of a heater (not shown).

Figure 5:
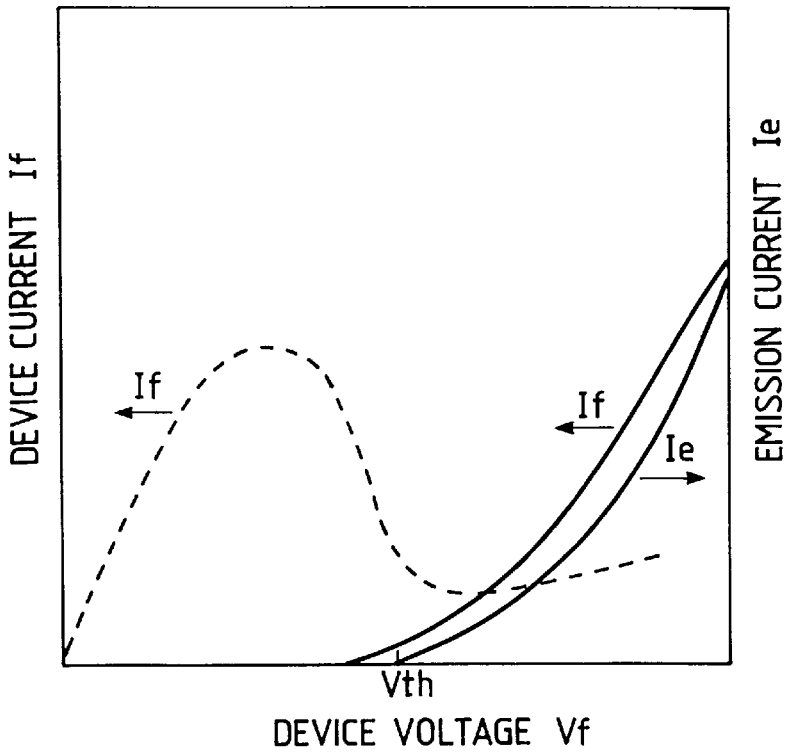
FIG. 5 is a graph showing a typical relationship between the device voltage Vf and the device current If and between the device voltage Vf and the emission current Ie of a surface conduction electron-emitting device prepared by a method according to the invention.

FIG. 5 shows a graph schematically illustrating the relationship between the device voltage Vf and the emission current Ie and the device current If typically observed by the gauging system of FIG. 5. Note that different units are arbitrarily selected for Ie and If in FIG. 5 in view of the fact that Ie has a magnitude by far smaller than that of If. Note that both the vertical and transversal axes of the graph represent a linear scale.

As seen in FIG. 5, an electron-emitting device according to the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter and indicated by Vth in FIG. 5), whereas the emission current Ie is practically undetectable when the applied voltage is found lower than the threshold value Vth. Differently stated, an electron-emitting device according to the invention is a non-linear device having a clear threshold voltage Vth to the emission current Ie.

(ii) Secondly, since the emission current Ie is highly dependent on the device voltage Vf, the former can be effectively controlled by way of the latter.

(iii) Thirdly, the emitted electric charge captured by the anode 54 is a function of the duration of time of application of the device voltage Vf. In other words, the amount of electric charge captured by the anode 54 can be effectively controlled by way of the time during which the device voltage Vf is applied.

Because of the above remarkable features, it will be understood that the electron-emitting behavior of an electron source comprising a plurality of electron-emitting devices according to the invention and hence that of an image-forming apparatus incorporating such an electron source can easily be controlled in response to the input signal. Thus, such an electron source and an image-forming apparatus may find a variety of applications.

On the other hand, the device current If either monotonically increases relative to the device voltage Vf (as shown by a solid line in FIG. 5, a characteristic referred to as "MI characteristic" hereinafter) or changes to show a curve as shown by a dotted line specific to a voltage-controlled-negative-resistance characteristic (a characteristic referred to as "VCNR characteristic" hereinafter). These characteristics of the device current are dependent on a number of factors including the manufacturing method, the conditions where it is gauged and the environment for operating the device.

Because of the remarkable characteristic features of a surface conduction electron-emitting device manufactured by a method according to the invention, a number of such electron-emitting devices arranged in an electron source or an image-forming apparatus comprising such an electron source can be controlled for electron emission and, therefore, such an electron source and an image-forming apparatus may also find a variety of applications.

Now, an electron source realized by arranging a number of surface conduction electron-emitting devices according to the invention will be described.

For instance, a number of electron-emitting devices may be arranged in parallel rows along a direction to realize a ladder-like arrangement. Alternatively, a plurality of electron-emitting devices may be arranged in rows along an X-direction and columns along a Y-direction to form a matrix, the X- and Y-directions being perpendicular to each other, and the electron-emitting devices are connected to related respective X- and Y-directional wires by way of the electrodes of each device, said Y-directional wires being disposed on said X-directional wires with an interlayer insulation layer interposed therebetween. The latter arrangement is referred to as a simple matrix arrangement. Now, the simple matrix arrangement will be described in detail.

In view of the above described three basic characteristic features of a surface conduction electron-emitting device, it can be controlled for electron emission by controlling the wave height and the wave width of the pulse voltage applied to the opposite electrodes of the device, or device voltage Vf, above the threshold voltage level Vth. On the other hand, the device does not practically emit any electron below the threshold voltage level Vth. Therefore, regardless of the number of electron-emitting devices arranged in an apparatus, desired surface conduction electron-emitting devices can be selected and controlled for electron emission in response to an input signal by applying a pulse voltage to each of the selected devices.

Figure 6:
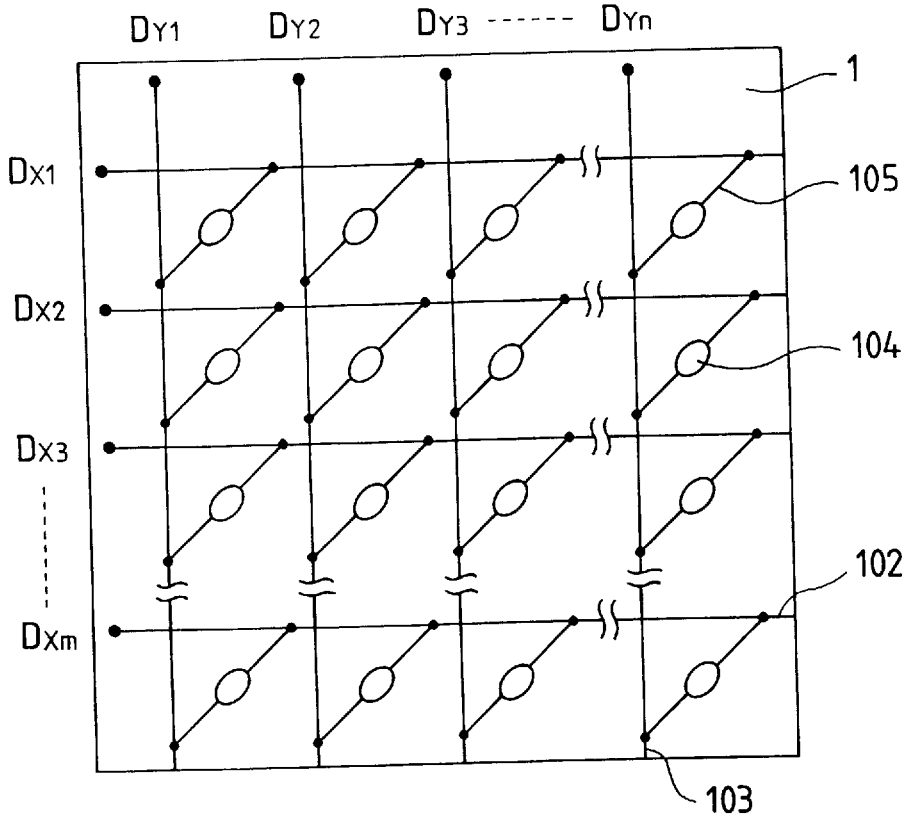
FIG. 6 is a schematic plan view of a simple matrix type electron source prepared by a method according to the invention.

FIG. 6 is a schematic plan view of an electron source realized by arranging a plurality of electron-emitting devices in matrix arrangement in order to exploit the above characteristic features. The electron source of FIG. 6 will be described further.

In FIG. 6, the electron source comprises a substrate 1 typically made of glass plate as described earlier and a number of surface conduction electron-emitting devices 104 arranged on the substrate 1. The number and the configuration of the surface conduction electron-emitting devices 104 may be appropriately selected.

There are provided a total of m X-directional wires 102, which are donated by Dx1, Dx2, . . . , Dxm and typically made of an electroconductive metal produced by vacuum deposition, printing or sputtering on the substrate 1. These wires are so designed in terms of material, thickness and width that a substantially equal voltage may be applied to the surface conduction electron-emitting devices 104.

A total of n Y-directional wires 103 are arranged and donated by Dy1, Dy2, . . . , Dyn, which are similar to the X-directional wires in terms of material, thickness and width.

An interlayer insulation layer (not shown) is disposed between the m X-directional wires 102 and the n Y-directional wires 103 to electrically isolate them from each other. Both m and n are integers.

The interlayer insulation layer (not shown) is typically made of $SiO_2$ and formed on the entire surface or part of the surface of the insulating substrate 1 to show a desired contour by means of vacuum deposition, printing or sputtering. The thickness, material and manufacturing method of the interlayer insulation layer are so selected as to make it withstand the potential difference between any of the X-directional wires 102 and any of the Y-directional wires 103 observable at the crossing thereof.

The oppositely arranged electrodes (not shown) of each of the surface conduction electron-emitting devices 104 are connected to related one of the m X-directional wirings 102 and related one of the n Y-directional wirings 103 by respective connecting wires 105 which are made of an electroconductive metal and formed by means of vacuum deposition, printing or sputtering.

The m X-directional wires 102, the n Y-directional wires 103, the connecting wires 105 and the device electrodes may be partly or entirely made of a common material or different materials. These materials may be appropriately selected typically from the candidate materials listed above for the device electrodes. If the device electrodes and the connecting wires are made of a same material, they may be collectively called device electrodes without discriminating the connecting wires. The surface conduction electron-emitting devices 104 may be formed on the substrate 1 or on the interlayer insulation layer (not shown).

As will be described in greater detail hereinafter, the X-directional wires 102 are electrically connected to a scan signal application means (not shown) for applying a scan signal to a selected row of surface conduction electron-emitting devices 104 arranged in the X-direction.

On the other hand, the Y-directional wires 103 are electrically connected to a modulation signal generation means (not shown) for applying a modulation signal to a selected column of surface conduction electron-emitting devices 104 arranged in the Y-direction and modulating the selected column according to an input signal. Note that the drive signal to be applied to each surface conduction electron-emitting device 104 is expressed as the voltage difference of the scan signal and the modulation signal applied to the device.

Figure 7:
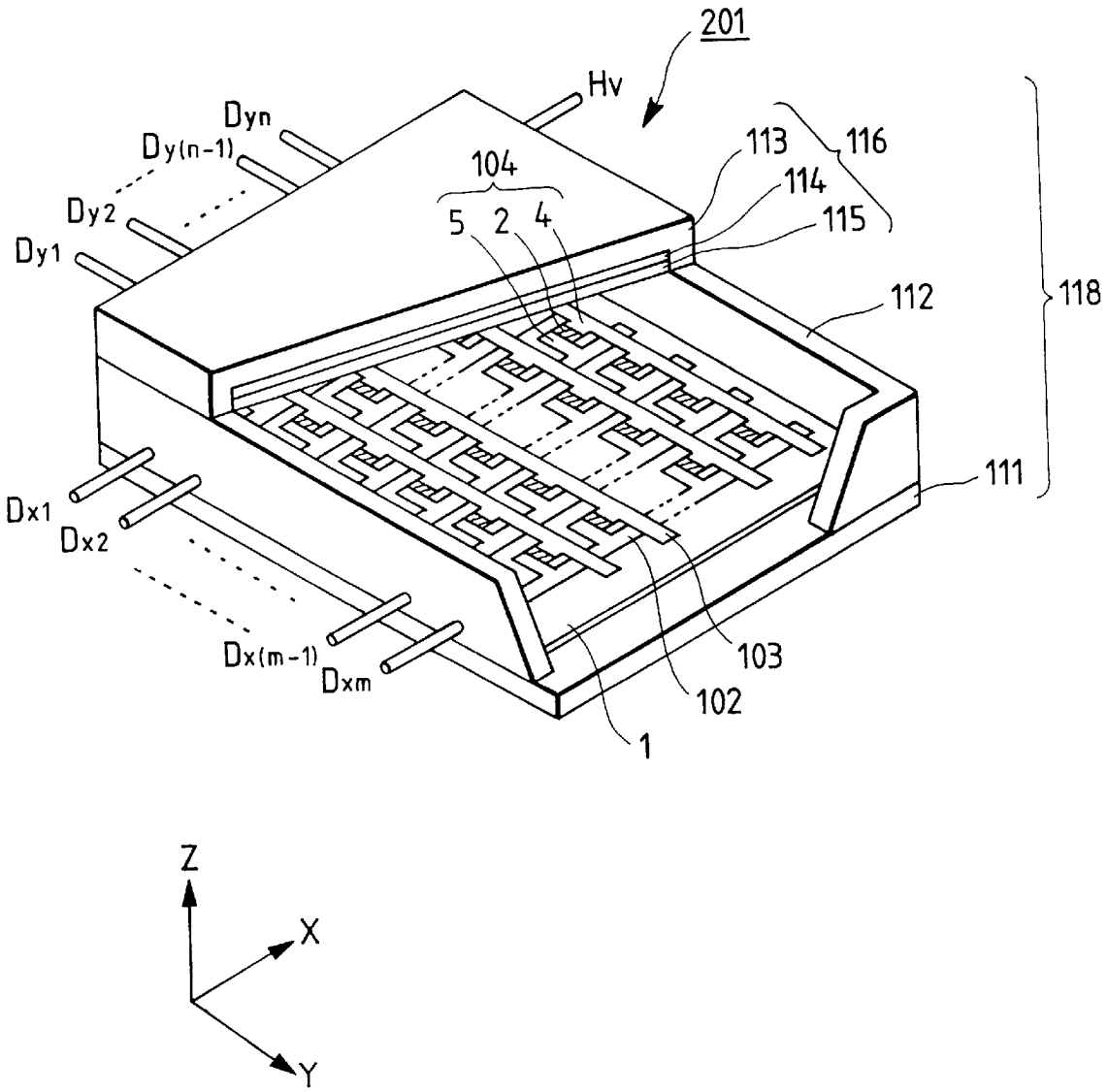
FIG. 7 is a partially cut out schematic perspective view of a display panel having a simple matrix type electron source prepared by a method according to the invention.
Figure 8A:
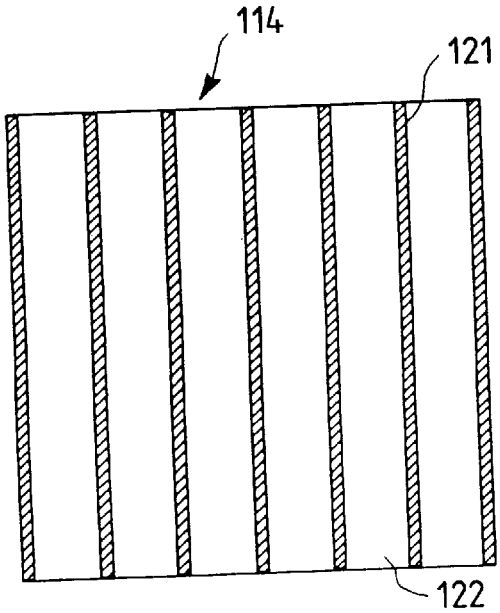
FIGS. 8A and 8B are schematic views, illustrating two possible configurations of fluorescent film that can be used for a display panel of an image forming apparatus prepared by a method according to the invention.
Figure 8B:
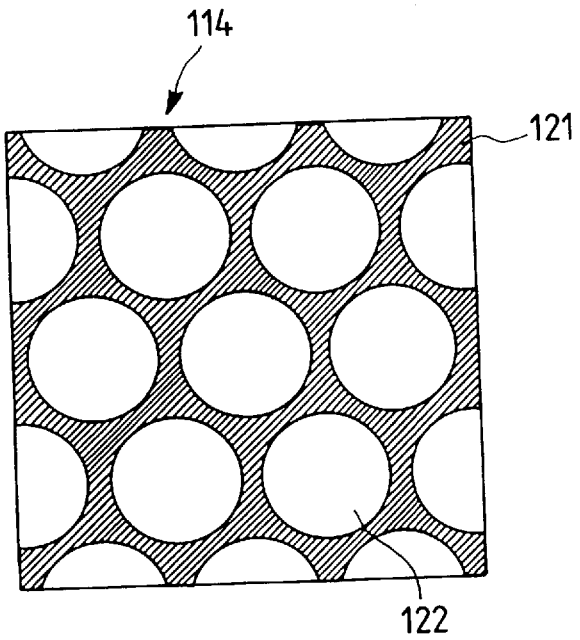
Figure 9:
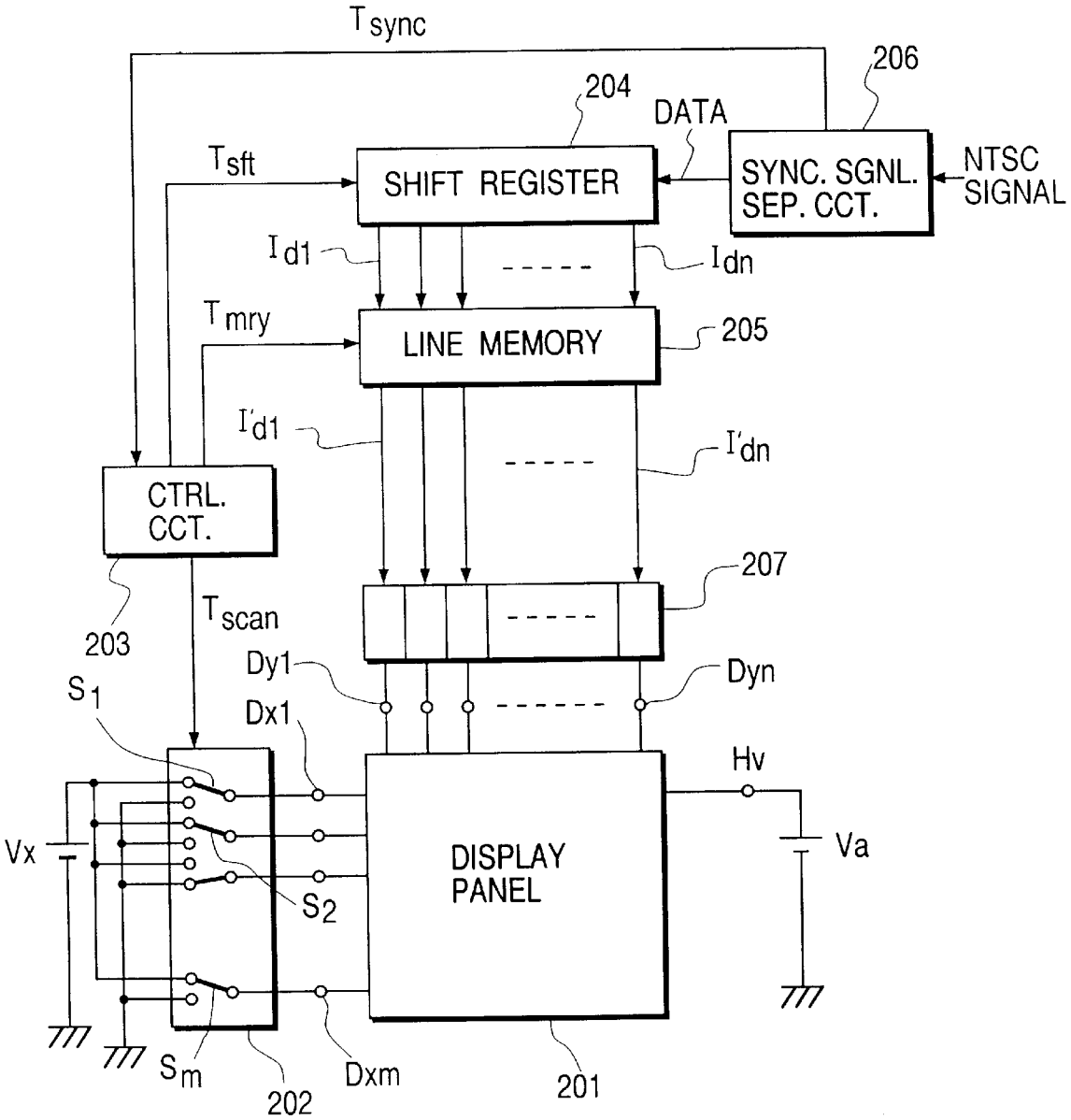
FIG. 9 is a block diagram of a drive circuit of an image forming apparatus for displaying images according to NTSC system television signals.

Now, an image-forming apparatus comprising an electron source having a simple matrix arrangement as described above will be described by referring to FIGS. 7 through 9. FIG. 7 is a partially cut away schematic perspective view showing the basic configuration of the display panel of the image forming apparatus and FIGS. 8A and 8B are schematic views, illustrating two possible configurations of a fluorescent film 114 that can be used for the image forming apparatus of FIG. 7, whereas FIG. 9 is a block diagram of a drive circuit for the image forming apparatus of FIG. 7 that operates for displaying television images according to NTSC television signals.

Referring firstly to FIG. 7 illustrating the basic configuration of the display panel of the image-forming apparatus, it comprises an electron source substrate 1 of the above described type carrying thereon a plurality of electron-emitting devices, a rear plate 111 rigidly holding the electron source substrate 1, a face plate 116 prepared by laying a fluorescent film 114 and a metal back 115 on the inner surface of a glass substrate 113 and a support frame 112, to which the rear plate 111 and the face plate 116 are bonded by means of frit glass and baked to 400° to 500° C. for more than 10 minutes in the atmosphere or in a nitrogen atmosphere to form a hermetically and airtightly sealed envelope 118.

In FIG. 7, reference numerals 102 and 103 respectively denotes the X-directional and Y-directional wires connected to the respective device electrodes 4, 5 of each electron-emitting device 104 and provides with respective external terminals Dx1 through Dxm and Dy1 through Dyn.

While the envelope 118 is formed of the face plate 116, the support frame 112 and the rear plate 111 in the above described embodiment, the rear plate 111 may be omitted if the substrate 1 is strong enough by itself because the rear plate 111 is provided mainly for reinforcing the substrate 1. If such is the case, an independent rear plate 111 may not be required and the substrate 1 may be directly bonded to the support frame 112 so that the envelope 118 is constituted of a face plate 116, a support frame 112 and a substrate 1. The overall strength of the envelope 118 may be increased by arranging a number of support members called spacers (not shown) between the face plate 116 and the rear plate 111.

While the fluorescent film 114 comprises only a single fluorescent body 122 if the display panel is used for showing black and white pictures, it needs to comprise for displaying color pictures black conductive members 121 and fluorescent bodies 122, of which the former are referred to as black stripes (FIG. 8A) or members of a black matrix (FIG. 8B) depending on the arrangement of the fluorescent bodies 122. Black stripes or members of a black matrix are arranged for a color display panel so that the fluorescent bodies 122 of three different primary colors are made less discriminable and the adverse effect of reducing the contrast of displayed images of external light reflected by the fluorescent film 114 is weakened by blackening the surrounding areas. While graphite is normally used as a principal ingredient of the black conductive members 121, other black conductive material having low light transmissivity and reflectivity may alternatively be used.

A precipitation or printing technique is suitably be used for applying fluorescent bodies 122 onto the glass substrate 113 regardless of black and white or color display.

As shown in FIG. 7, a metal back 115 is normally arranged on the inner surface of the fluorescent film 114. The metal back 115 is provided in order to enhance the luminance of the display panel by causing the rays of light emitted from the fluorescent bodies 122 (FIGS. 8A and 8B) and directed to the inside of the envelope to be mirror reflected toward the face plate 116, to use it as an electrode for applying an accelerating voltage from a high voltage terminal Hv to electron beams and to protect the fluorescent bodies against damages that may be caused when negative ions generated inside the envelope 118 collide with them. It is prepared by smoothing the inner surface of the fluorescent film 114 (in an operation normally called "filming") and forming an Al film thereon by vacuum deposition after forming the fluorescent film 114.

A transparent electrode (not shown) may be formed on the face plate 116 facing the outer surface of the fluorescent film 114 in order to raise the conductivity of the fluorescent film 114.

Care should be taken to accurately align each set of color fluorescent bodies 122 and an electron-emitting device 104, if a color display is involved, before the above listed components of the envelope are bonded together.

The envelope 118 is hermetically sealed after evacuating the inside through an exhaust pipe (not shown) to a degree of vacuum of $10^{-4}$ to $10^{-5}$ Pa.

After evacuating the inside of the envelope 118 through an exhaust pipe (not shown) and by means of an appropriate vacuum system comprising a rotary pump or a turbo pump to a degree of vacuum of about $10^{-4}$ Pa and applying a voltage to the device electrodes 4, 5 by way of the external terminals Dx1 through Dxm and Dy1 through Dyn for an activation process, the vacuum system may be replaced by a ultrahigh vacuum system comprising an ion pump or a sorption pump that does not involve the use of oil and the envelope may be baked at 80° to 150° C. for 3 to 15 hours. A getter process may be conducted in order to maintain the achieved degree of vacuum in the inside of the envelope 118 immediately before or after it is hermetically sealed. In a getter process, a getter (not shown) arranged at a predetermined position in the envelope 118 is heated by means of a resistance heater or a high frequency heater to form a film of the getter by vapor deposition. A getter typically contains Ba as a principal ingredient and can maintain a degree of vacuum between $1\times10^{-3}$ and $1\times10^{-5}$ Pa by the adsorption effect of the vapor deposition film.

Now, a drive circuits for driving a display panel 201 as described above will be described by referring to FIG. 9. In FIG. 9, reference numeral 201 denotes a display panel. Otherwise, the circuit comprises a scan circuit 202, a control circuit 203, a shift register 204, a line memory 205, a synchronizing signal separation circuit 206 and a modulation signal generator 207. Vx and Va in FIG. 9 denote DC voltage sources.

As shown in FIG. 9, the display panel 201 is connected to external circuits via terminals Dx1 through Dxm, Dy1 through Dyn and high voltage terminal Hv, of which terminals Dx1 through Dxm are designed to receive scan signals for sequentially driving on a one-by-one basis the rows (of n devices) of an electron source in the apparatus comprising a number of surface-conduction type electron-emitting devices arranged in the form of a matrix having M rows and N columns.

On the other hand, terminals Dy1 through Dyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction type electron-emitting devices.

The scan circuit 202 operates in a manner as follows. The circuit comprises M switching devices (of which only devices S1 and Sm are specifically and schematically indicated in FIG. 9), each of which takes either the output voltage of the DC voltage source Vx or 0V (the ground potential level) and comes to be connected with one of the terminals Dx1 through Dxm of the display panel 201. Each of the switching devices S1 through Sm operates in accordance with control signal Tscan fed from the control circuit 203 and can be prepared by combining transistors such as FETs.

The DC voltage source Vx of this circuit is designed to output a constant voltage such that any drive voltage applied to devices that are not being scanned due to the performance of the surface conduction electron-emitting devices (or the threshold voltage for electron emission) is reduced to less than threshold voltage.

The control circuit 203 coordinates the operations of related components so that images may be appropriately displayed in accordance with externally fed video signals. It generates control signals Tscan, Tsft and Tmry in response to synchronizing signal Tsync fed from the synchronizing signal separation circuit 206, which will be described below.

The synchronizing signal separation circuit 206 separates the synchronizing signal component and the luminance signal component form an externally fed NTSC television signal and can be easily realized using a popularly known frequency separation (filter) circuit. Although a synchronizing signal extracted from a television signal by the synchronizing signal separation circuit 206 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 204, is designated as DATA signal for convenience sake.

The shift register 204 carries out for each line a serial/parallel conversion on DATA signals that are serially fed on a time series basis in accordance with control signal Tsft fed from the control circuit 203. In other words, a control signal Tsft operates as a shift clock for the shift register 204. A set of data for a line that have undergone a serial/parallel conversion (and correspond to a set of drive data for n electron-emitting devices) are sent out of the shift register 204 as n parallel signals Id1 through Idn.

The line memory 205 is a memory for storing a set of data for a line, which are signals Id1 through Idn, for a required period of time according to control signal Tmry coming from the control circuit 203. The stored data are sent out as I'd1 through I'dn and fed to modulation signal generator 207.

Said modulation signal generator 207 is in fact a signal line that appropriately drives and modulates the operation of each of the surface-conduction type electron-emitting devices according to each of the image data I'd1 through I'dn and output signals of this device are fed to the surface-conduction type electron-emitting devices in the display panel 201 via terminals Dy1 through Dyn.

As described earlier, there exists a clear threshold voltage for a surface conduction electron-emitting device and the device emit electrons only a voltage exceeding the threshold voltage is applied thereto. The level of emission current changes as a function of the change in the applied voltage above the threshold level. While the value of the threshold voltage and the relationship between the applied voltage and the emission current may vary depending on the materials, the configuration and the manufacturing method of the electron-emitting device, the following description holds true in any case.

When a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that, firstly, the intensity of an output electron beam can be controlled by changing the peak level of the pulse-shaped voltage. Secondly, the total amount of electric charge of an electron beam can be controlled by varying the pulse width.

Thus, either voltage modulation method or pulse width modulation may be used for modulating an electron-emitting device in response to an input signal. With voltage modulation, a voltage modulation type circuit is used for the modulation signal generator 207 so that the peak level of the pulse-shaped voltage is modulated according to input data, while the pulse width is held constant. With pulse width modulation, on the other hand, a pulse width modulation type circuit is used for the modulation signal generator 207 so that the pulse width of the applied voltage may be modulated according to input data, while the peak level of the applied voltage is held constant.

Although it is not particularly mentioned above, the shift register 204 and the line memory 205 may be either of digital or of analog signal type so long as serial/parallel conversions and storage of video signals are conducted at a given rate.

If digital signal type devices are used, output signal DATA of the synchronizing signal separation circuit 206 needs to be digitized. However, such conversion can be easily carried out by arranging an A/D converter at the output of the synchronizing signal separation circuit 206.

It may be needless to say that different circuits may be used for the modulation signal generator 207 depending on if output signals of the line memory 205 are digital signals or analog signals.

If digital signals are used, a D/A converter circuit of a known type may be used for the modulation signal generator 207 and an amplifier circuit may additionally be used, if necessary. As for pulse width modulation, the modulation signal generator 207 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 207 and a level shift circuit may be added thereto if necessary. As for pulse width modulation, a known voltage control type oscillation circuit (VCO) may be used with, if necessary, an additional amplifier to be used for voltage amplification up to the drive voltage of surface-conduction type electron-emitting device.

With an image forming apparatus according to the invention and comprising a display panel 201 and a drive circuit a configuration as described above, the electron-emitting devices 104 emit electrons as a voltage is applied thereto by way of the external terminals Dx1 through Dxm and Dy1 through Dyn. Then, the generated electron beams are accelerated by applying a high voltage to the metal back 115 or a transparent electrode (not shown) by way of the high voltage terminal Hv. The accelerated electrons eventually collide with the fluorescent film 114, which by turn glows to produce television images according to NTSC signals.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is particularly suited for TV signals involving a larger number of scanning lines typically of a high definition TV system such as the MUSE system because it can be used for a large display panel comprising a large number of pixels.

Now, an electron source comprising a plurality of surface conduction electron-emitting devices arranged in a ladder-like manner on a substrate and an image-forming apparatus comprising such an electron source will be described by referring to FIGS. 10 and 11.

Figure 10:
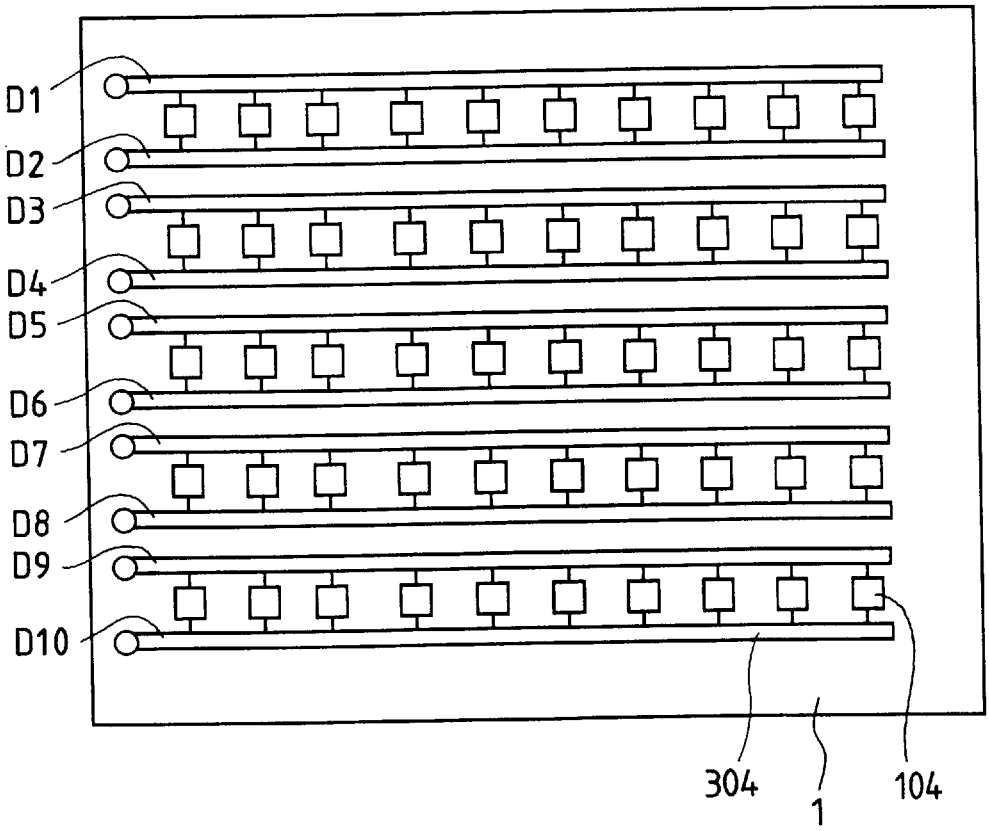
FIG. 10 is a schematic plan view of a ladder type electron source prepared by a method according to the invention.

Firstly referring to FIG. 10, reference numeral 1 denotes an electron source substrate and reference numeral 104 denotes a surface conduction electron-emitting device arranged on the substrate, whereas reference numeral 304 denotes 10 common wires having respective external terminals D1 through D10 for connecting the surface conduction electron-emitting devices 104.

The electron-emitting devices 104 are arranged in rows, which will be referred to as device rows hereinafter, to form an electron source comprising a plurality of device rows, each row having a plurality of devices.

The surface conduction electron-emitting devices of each device row are electrically connected in parallel with each other by a pair of common wires 304 (e.g., common wires 304 for external terminals D1 and D2) so that they can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wire. Thus, of the external terminals D2 through D9, D2 and D3, D4 and D5, D6 and D7 and D8 and D9 can share a single common wire instead of two wires.

Figure 11:
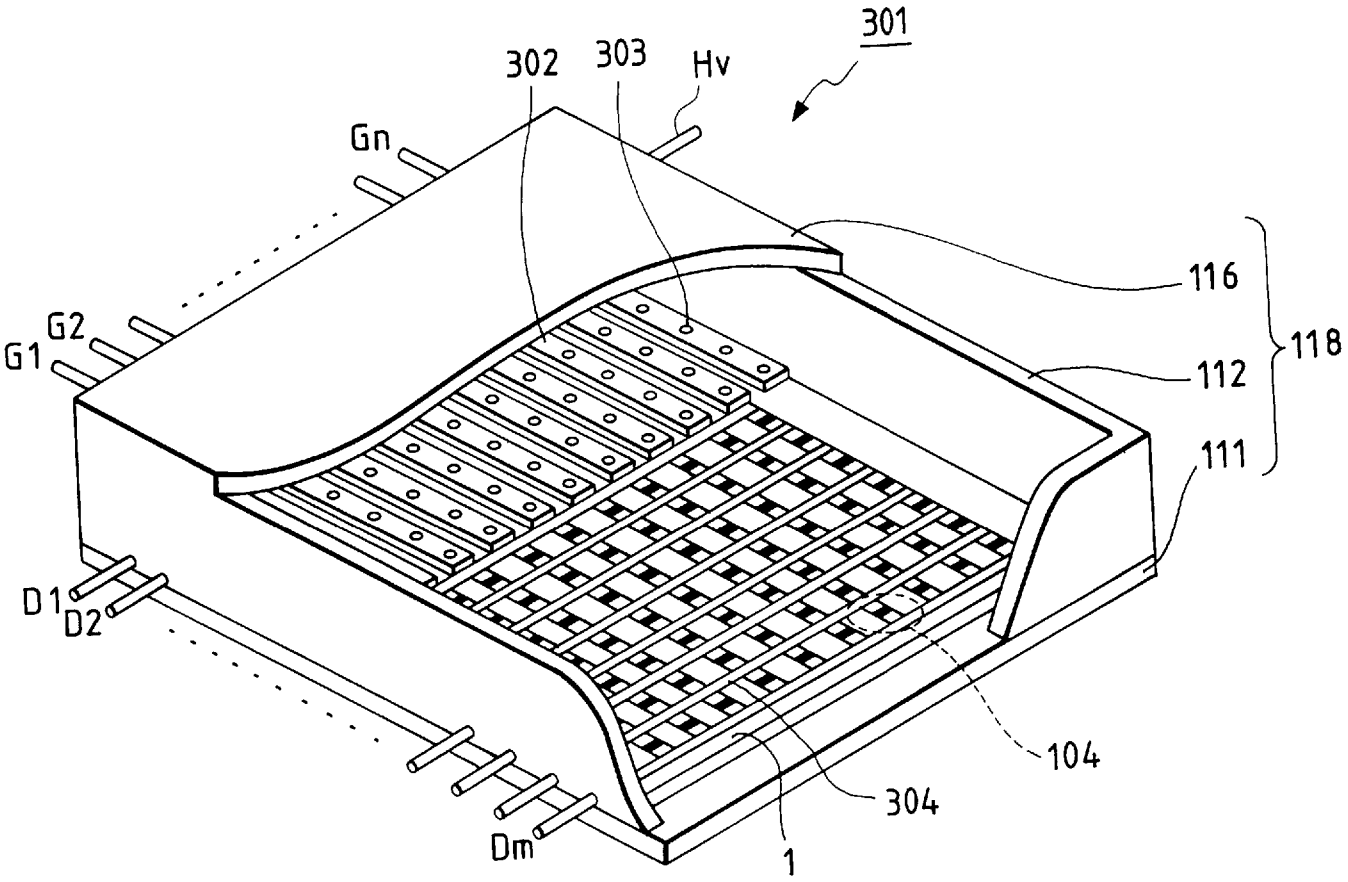
FIG. 11 is a partially cut out schematic perspective view of a display panel having a ladder type electron source prepared by a method according to the invention.

FIG. 11 is a schematic perspective view of the display panel 301 incorporating an electron source having a ladder-like arrangement of electron-emitting devices. In FIG. 11, the display panel comprises grid electrodes 302, each provided with a number of bores 303 for allowing electrons to pass therethrough and a set of external terminals D1, D2, . . . , Dm along with another set of external terminals G1, G2, . . . , Gn connected to the respective grid electrodes 302 and common wires 304 formed integrally and arranged on a substrate 1.

The components of image forming apparatus of FIG. 11 that are similar to those of the image-forming apparatus of FIG. 7 are denoted respectively by the same reference symbols and differs from the image forming apparatus with a simple matrix arrangement of FIG. 7 mainly in that the apparatus of FIG. 11 has grid electrodes 302 arranged between the substrate 1 and the face plate 116.

As described above, the grid electrodes 302 are arranged between the substrate 1 and the face plate 116. The grid electrodes 302 can modulate electron beams emitted from the surface conduction electron-emitting devices,104 and are disposed perpendicularly relative to the devices arranged in rows in a ladder-like arrangement and provided with circular through bores 303 in one-to-one correspondence to respective surface conduction electron-emitting devices 104 in order to allow electron beams to pass therethrough.

Note that, however, while stripe-shaped grid electrodes 302 are shown in FIG. 11, the profile and the locations of the electrodes are not limited thereto. For example, they may alternatively be provided with mesh-like openings 303 and arranged around or close to the surface conduction electron-emitting devices 104.

The external terminals D1 through Dm and the external terminals for the grids G1 through Gn are electrically connected to a control circuit (not shown). An image-forming apparatus having a configuration as described above can be operated for electron beam irradiation by simultaneously applying modulation signals to the rows of grid electrodes 302 for a single line of an image in synchronism with the operation of driving (scanning) the electron-emitting devices on a row by row basis to irradiate the fluorescent film 114 with electron beams so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

[EXAMPLES]

Now, the present invention will be described by way of examples.

[Example 1]

This example can conveniently illustrates a method of manufacturing a surface conduction electron-emitting device having a configuration of FIGS. 1A and 1B according to the invention.

In this Example, a number of surface conduction electron-emitting devices having a configuration as shown in FIGS. 1A and 1B were prepared by using a quartz glass substrate 1 for each device. The device electrodes 4, 5 were made of a two-layered film of Ti and Pt having respective thicknesses of 5 nm and 30 nm. In each device, the device electrodes 4, 5 were separated by a distance L of 20 $\mu$m and had a width W2 of 300 $\mu$m.

Of the electroconductive thin film 3 including an electron-emitting region 2 of each device, the region 6 for making an electron-emitting region is made of PdO, whereas the remaining region is made of Pd. The electroconductive thin film 3 had a width W2 of 300 $\mu$m.

The method used for manufacturing the surface conduction electron-emitting devices in this example will be described below in terms of a single device by referring to FIGS. 12A through 12F. Note that the steps a through f below correspond to FIGS. 12A through 12F and steps g and h are not shown in the drawings.

Figure 12A:
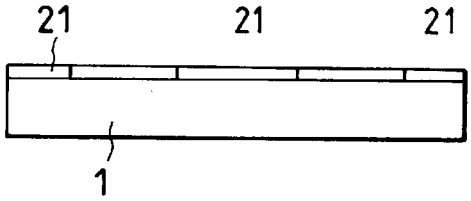
FIGS. 12A through 12F are schematic views of the surface conduction electron-emitting device of Example 1 in different manufacturing steps.

Step-a: After thoroughly cleansing a quartz glass substrate 1 with a neutral detergent, an organic solvent and water, a resist layer was formed by spinner coating and subjected to ordinary masked exposure and photochemical development to produce a resist pattern 21 (FIG. 12A).

Figure 12B:
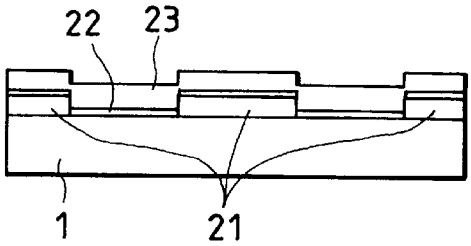

Step-b: A Ti film 22 and a Pt film 23 were formed to respective thicknesses of 5 nm and 30 nm by high frequency sputtering (FIG. 12B).

Figure 12C:
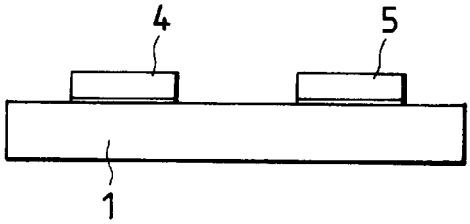
Figure 12D:
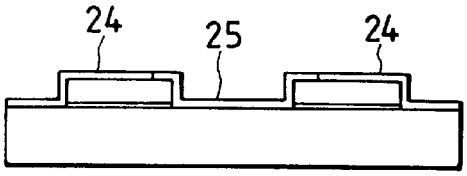

Step-c: Device electrodes 4, 5 were obtained by lifting off the resist pattern (FIG. 12C).

Step-d: After forming a Cr film 24 by vacuum deposition, a window 25 was prepared for a region for an electroconductive thin film for forming an electron-emitting region by ordinary photolithography.

Figure 12E:
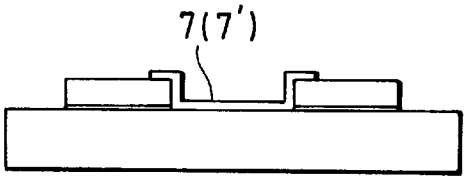

Step-e: An organic palladium complex solution (cccp-4230: tradename, available from Okuno Pharmaceuticals Co., Ltd.) was applied by spinner coating and heated at 300° C. for 12 minutes in the atmosphere to produce a film of PdO fine particles. A desired pattern of the PdO film was prepared by lifting off the Cr film 24 and the PdO was reduced by heating at 200° C. for 10 minutes in a mixture gas flow of $N_2$-2% $H_2$ to produce a thin film 7 for forming an electron-emitting region made of Pd fine particles (FIG. 12E).

Figure 12F:
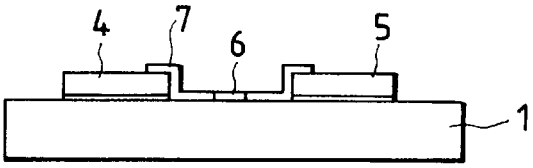

Step-f: A region 6 for making an electron-emitting region was produced in a desired area of the thin film 7 for forming an electron-emitting region by means of an apparatus illustrated in FIG. 13 (FIG. 12F). This step will be described below in greater detail by referring to FIG. 13.

The workpiece of device 31 is set in position on a heating stage 32. The base member of the heating stage 32 is made of a platinum plate in order to an even distribution of temperature of the upper surface thereof. Heating means 33 is arranged in the heating stage 32 and comprises a heater and a temperature sensor. Reference numeral 34 denotes an insulation layer of quartz glass lined with a thin metal film formed by vapor deposition in order to prevent heat loss due to irradiation. Reference numeral 35 denotes a water cooling block and reference numerals 36 and 37 respectively denote an X-Y stage and a drive mechanism for the X-Y stage 36. With the above described arrangement, the device 31 can be two-dimensionally scanned. The entire scanning mechanism is placed in a reaction tank 38. The internal atmosphere of the reaction tank 38 can be controlled by causing an appropriate gas to flow therethrough. Reference numerals 39 and 49 respectively denote a gas injection port and a gas discharge port. Wires for controlling the operation of the heating means 33 and the X-Y stage drive mechanism 37 and a water cooling tube connected to the water cooling block 35 led out of the reaction tank 38 by way of a feed through 41.

Now an optical system arranged in the apparatus to concentrate ultraviolet rays will be described. It comprises a light source 42, which was an ultraviolet lamp with a wavelength of 254 nm for the present example, a reflector 43 and an optical converging system 44 comprising a lens and slit. Ultraviolet rays are introduced into the reaction tank 38 through an ultraviolet rays transmitting window. Reference numeral 46 denotes a movable mirror and reference numeral 47 denotes an optical aligning system to be used to determine in advance the position to be irradiated with ultraviolet rays. It will be removed from the transmission path of ultraviolet rays by displacing the movable mirror before the operation of irradiation of ultraviolet rays.

In the present example, the device 31 was set in position in the above apparatus and $O_2$ gas was injected into the reaction tank 38. Then, the temperature of the heating stage 31 was set to 150° C. and a central area of the thin film 7 for forming an electron-emitting region extending between the device electrodes 4, 5 of the device 31 and made of Pd was scanned transversally and repeatedly by a focused spot of ultraviolet rays, driving the X-Y stage 36 for 1 hour. It was observed through an optical microscope that, as a result of the above process, a discolored region (region 6 for making an electron-emitting region—FIG. 12F) having a width of about 5 $\mu$m had been produced in a central area of the Pd film. When a specimen that had undergone the above steps was subjected to laser-Raman spectral analysis, it was confirmed that the region 6 for forming an electron-emitting region was made of PdO.

Step-g: Subsequently, the device was moved into the vacuum chamber 55 of a gauging system as illustrated in FIG. 4 and the inside of the chamber was evacuated by means of a vacuum pump 56 to produce a degree of vacuum of $1\times10^{-3}$ Pa within the vacuum chamber 55. Thereafter, device voltage Vf was applied to the device electrodes 4, 5 from the power source 51 for an energization forming process. The voltage waveform of FIG. 3B was used for the energization forming.

For the present example, T1 and T2 of FIG. 3B were respectively 1 msec. and 10 msec. and the wave height (or the peak voltage for the energization forming) of the triangular wave was incrementally raised by 0.1V.

As a result of the energization forming process, an electron-emitting region 2 was produced in a central area of the region 6 for making an electron-emitting region. When observed through a scanning electron microscope, the swerving of the electron-emitting region 2 was found within 2 $\mu$m for most of the specimens prepared in this example.

Step-h: Then, PdO of the region 6 of making an electron-emitting region was chemically reduced by keeping it in a gas flow of a mixture gas of $N_2$-2% $H_2$ for 1 hour and, thereafter, the device was put back into the vacuum chamber of the gauging system of FIG. 4, which was evacuated to a degree of vacuum of $1\times10^{-3}$ Pa for an activation process carried out by applying a pulse voltage as in the case of the energization forming. The pulse voltage had a peak voltage level of 14V, a pulse width of 100 $\mu$sec., and a pulse interval of 10 nm. The activation process was carried out, while observing the emission current Ie of the device.

When the emission current Ie reached to a saturation level, the luminance of the fluorescent body fitted to the anode 54 in advance was measured. The pulse voltage used to drive the device to determine the luminance of the fluorescent body was same as the one used for the activation process.

[Comparative Example 1]

In this example, specimens for comparison were prepared by following Step-a through Step-d of Example 1 and then the following steps.

1) An organic palladium complex solution (cccp-4230: tradename, available from Okuno Pharmaceuticals Co., Ltd.) was applied by spinner coating and heated at 300° C. for 12 minutes in the atmosphere to produce a film of PdO fine particles. A thin film 7' for forming an electron-emitting region made of PdO fine particles was produced by lifting off the Cr film 24 (FIG. 12E).

2) An energization forming process was carried out as in the case of Step-g of Example 1. An electron-emitting region was produced in a central area of the electroconductive thin film between the device electrodes as a result of energization forming but showed a swerve to an extent of 7 to 10 $\mu$m.

3) Then, PdO of the region of making an electron-emitting region was chemically reduced by keeping it in a gas flow of a mixture gas of $N_2$-2% $H_2$ for 1 hour and, thereafter, the device was subjected to an activation process as in the case of Example 1.

When the emission current Ie reached to a saturation level, the luminance of the fluorescent body fitted to the anode 54 in advance was measured. The pulse voltage used to drive the device to determine the luminance of the fluorescent body was same as the one used for the activation process.

The number of specimens prepared in Example 1 and that of Comparative Example 1 were equally ten, which showed the following deviations in the emission current Ie and the luminance of the fluorescent body.

TABLE 1

| | Ie deviation (%) | luminance deviation (%) |
|---|---|---|
| Example 1 | 5 | 5 |
| Compar. Example 1 | 8 | 8 |

[Example 2]

Specimen devices having a configuration as shown in FIGS. 1A and 1B were prepared by way of the following steps.

Step-a through Step-d: Step-a through Step-d of Example 1 were followed.

Step-e: An organic palladium complex solution (cccp-4230: tradename, available from Okuno Pharmaceuticals Co., Ltd.) was applied by spinner coating to produce a film of an organic palladium complex.

Step-f: As in the case of Example 1, a central area of the electroconductive thin film between the device electrodes of the device was scanned repeatedly by ultraviolet rays for 40 minutes, heat-treating the device in an oxygen gas flow at 200° C.

The temperature of the heat-treatment of this example has to be controlled to that of producing metal palladium by pyrolysis of the organic palladium complex, which is 200° C. or higher. However, if the temperature is too high, palladium oxide is produced in place of metal palladium to baffle the attempt of producing metal palladium. The temperature should be kept below 300° C.

Step-g: A thin film 7 for forming an electron-emitting region having a region 6 for making an electron-emitting region made of PdO and a remaining region made of Pd was prepared by lifting off the Cr film 24 and removing unnecessary portions of the Pd film (FIG. 12F).

Step-h: The device was then subjected to energization forming, chemical reduction and activation processes as Step-g and Step-h of Example 1.

Like the specimen devices of Example 1, those of this example showed a small swerve and operated effectively when tested with an arrangement described in Example 1.

[Example 3]

Devices having a configuration same as that of the devices of Example 1 were prepared by way of the following steps.

Step-a through Step-d: Exactly same as those of Example 1.

Step-e: An organic palladium complex solution (cccp-4230: tradename, available from Okuno Pharmaceuticals Co., Ltd.) was applied by spinner coating and heat-treated at 300° C. for 12 minutes in the atmosphere and then the Cr film 24 was lifted off to produce a thin film 7' for forming an electron-emitting region made of PdO fine particles.

Step-f: The device was placed in vacuum and the thin film 7 for forming an electron-emitting region was irradiated with electron beams, except a desired region located in a central area of the electroconductive thin film between the device electrodes. PdO in the region irradiated with electron beams was reduced to become Pd, whereas PdO in the region not irradiated with electron beams (region for making an electron-emitting region) remained unchanged. This treatment was carried out with a scanning electron microscope (SEM). The irradiation was carried out by scanning of electron beam of the SEM on the area said above.

Step-g: The device was then subjected to energization forming, chemical reduction and activation processes as Step-g and Step-h of Example 1.

Like the specimen devices of Example 1, those of this example showed a small swerve and operated effectively when tested with an arrangement described in Example 1.

[Example 4]

Devices having a configuration same as that of the devices of Example 1 were prepared by way of the following steps.

Step-a through Step-e: Exactly same Step-a through Step-e of Example 1.

Step-f: A region 6 for making an electron-emitting region was produced in a desired area of the thin film 7 for forming an electron-emitting region made of fine PdO particles by means of an apparatus illustrated in FIG. 13 (FIG. 12F). This step will be described below in greater detail by referring to FIG. 13.

An Ar ion laser having a wavelength of 514.5 nm was used for the light source 42 and the device was not heated in the heating stage 31. A central area of the electroconductive thin film between the device electrodes was scanned by a laser spot in a flow of oxygen gas. The spot had a diameter of about 1 $\mu$m. The laser power was 4 mW and the scanning speed was 10 $\mu$m/sec. As a result of this process, a region 6 for making an electron-emitting region having a width of about 1 $\mu$m was formed in the central area between the device electrodes (FIG. 12F). It was confirmed that this region had turned to PdO.

Step-g: The device was then subjected to energization forming, chemical reduction and activation processes as Step-g and Step-h of Example 1.

When observed through a scanning electron microscope, the swerving of the electron-emitting region 2 was found within 1 $\mu$m. It operated as effective as the devices of Example 1 when tested with an arrangement described in Example 1.

In Step-f of this example, a region for making an electron-emitting region made of PdO is prepared by thermally and locally oxidizing a desired area of the thin film for forming an electron-emitting region made of Pd. The light source 42 is not limited to the above described one and it may be replaced by other appropriate one such as a visible light or infrared laser or an infrared lamp. If a transparent substrate made of, for example, quartz is used, the substrate may be irradiated from the rear side with light that is focused exactly at the front surface of the substrate to produce a same effect.

[Example 5]

The electron-emitting region having a non-linear profile can also be produced with the technique of Example 4.

Figure 14:
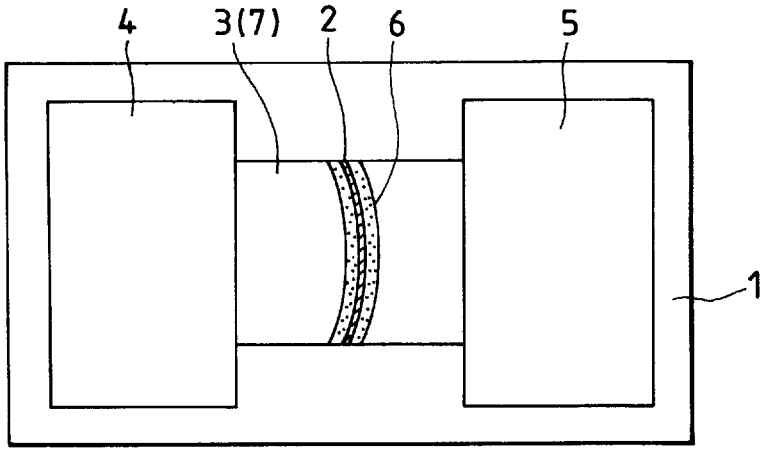
FIG. 14 is a schematic plan view of the surface conduction electron-emitting device of Example 5.

For example, a curved region 6 for making an electron-emitting region as shown in FIG. 14 can be produced by scanning a curved area located between the device electrodes with a laser beam in Step-f of Example 4. Then, as it is subjected to energization forming, a curved electron-emitting region 2 is prepared to show a profile same as that of the region 6 for making an electron-emitting region. With a surface conduction electron-emitting device comprising an electron-emitting region having such a profile, the divergence of emitted electrons can be controlled by appropriately selecting the direction along which a voltage is applied to the device electrodes 4, 5. Thus, if such surface conduction electron-emitting devices are used for the electron source of an image-forming apparatus, a simple design can be used for an electro-optical system for converging electron beams.

[Example 6]

Figure 15:
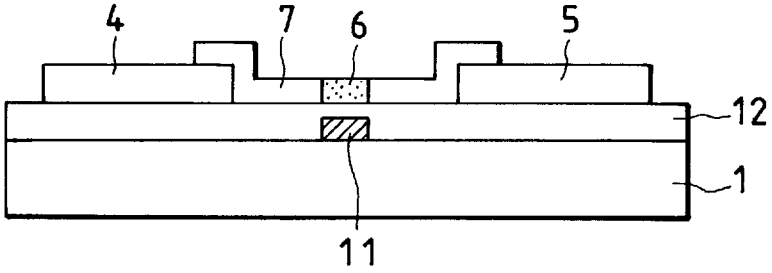
FIG. 15 is a schematic sectional view of the surface conduction electron-emitting device of Example 6.

As shown in FIG. 15, a light absorbing member 11 was arranged in advance on an insulating substrate 1 at a position directly below where a region 6 for making an electron-emitting region was to be formed and covered by an insulation layer 12 before producing device electrodes 4, 5 and a thin film 7 for forming an electron-emitting region. With this arrangement, the area irradiated with laser is effectively heated for thermal oxidation as described in Example 4 because of the presence of a light absorbing member 11 so that a low power laser can be used to avoid regions of the device other than the heated area from being damaged by heat.

In this example, the light absorbing member 11 was prepared by forming a vacuum deposition carbon film, using graphite as a source of carbon, and the insulation layer 12 was formed from $SiO_2$ by sputtering. Thereafter, the steps of Example 4 was followed to prepare surface conduction electron-emitting devices.

The technique used in this example is very effective for forming a large number of surface conduction electron-emitting devices that are arranged highly densely.

[Example 7]

In this example, a light reflecting member was arranged in advance directly below where a region for making an electron-emitting region was to be formed as in the case of Example 6. Consequently, the energy consumption rate for thermal oxidation was lower than that of Example 4 and regions of the device other than the heated area was protected against any possible damage by heat.

If, for example, an infrared lamp is used for the light source, the light reflecting member may suitably be made of Au that can efficiently reflect infrared rays. Then, the area to be irradiated with infrared rays absorbs transmitted infrared rays to efficiently become heated so that a low power lamp can be used for the light source.

[Example 8]

Figure 16:
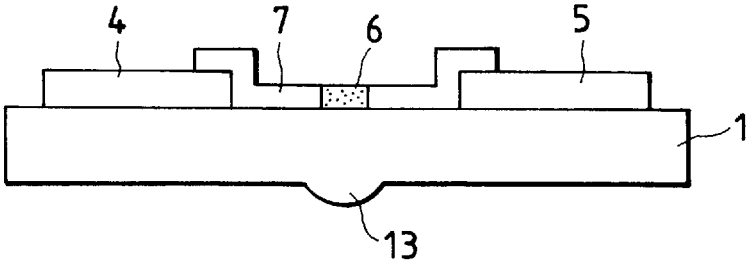
FIG. 16 is a schematic sectional view of the surface conduction electron-emitting device of Example 8.

In this example, a light converging member 13 was arranged at a predetermined position on the rear surface of an insulating substrate 1 as shown in FIG. 16 so that the process of thermal oxidation as described in Example 4 could be carried out with a reduced energy consumption rate to avoid regions of the device other than the heated area from being damaged by heat.

The light converging member 13 of this example operated as a lens. Therefore, as a large spot of light with a low energy density was irradiated from the rear side of a transparent insulating substrate 1, a converged flux of light with a high energy density was irradiated on a predetermined area of the thin film 7 for forming an electron-emitting region arranged on the front side of the insulating substrate 1 to produce a region 6 for making an electron-emitting region. In other words, all the regions other than the region 6 for making an electron-emitting region were hardly damaged by heat.

[Example 9]

In this example, a number of surface conduction electron-emitting devices having a configuration as shown in FIGS. 1A and 1B were prepared by way of the following steps. The region 6*b* for making an electron-emitting region of the electroconductive thin film 3 of each device prepared in this example was made of WN, whereas all the remaining regions of the device were made of W.

Step-a through Step-c: Exactly same Step-a through Step-c of Example 1.

Step-d: Resist was applied to the device, exposed to light and photochemically developed to produce a resist pattern.

Step-e: A film of fine particles of W (particle diameter: 2 nm–30 nm) was formed by gas deposition.

Step-f: The resist was peeled off and a thin film for forming an electron-emitting region made of fine particles of W was produced by using a lift-off technique.

Step-g: The device was placed in the apparatus of FIG. 13 and, after injecting $NH_3$ gas into the reaction tank 38, it was scanned by a laser spot coming from a light source 42 of Ar ion laser as in the case of Example 4. With this process, the fine particles of W in the area irradiated with laser were nitrided to produce a region for making an electron-emitting region.

Step-h: The device was then subjected to energization forming and activation processes as Step-g and Step-h of Example 1. Note that the device may be subjected to a reduction process in a flow of hydrogen gas after the process of energization forming and before an activation process.

Like the specimen devices of Example 1, those of this example showed a small swerve and operated effectively when tested with an arrangement described in Example 1.

[Example 10]

Surface conduction electron-emitting devices having a configuration as shown in FIGS. 1A and 1B were prepared by way of the following steps. The distance separating the device electrodes of each device was made as large as 1 mm.

The prepared region for making an electron-emitting region of each devices was showed a width of about 1 $\mu$m as in the case of Example 4. The swerving of the electron-emitting region 2 was found within 1 $\mu$m.

[Comparative Example 2]

Surface conduction electron-emitting devices were prepared as in the case of Comparative Example 1, except that the distance separating the device electrodes of each device was made as large as 1 mm. As a result, the produced electron-emitting region of each device shows a swerving of about 100 $\mu$m.

Ten specimen devices were prepared in Example 10 above and also in Comparative Example 2 and tested for performance as in the case of Example 1. Table 2: shows the test result.

TABLE 2

| | Ie deviation (%) | luminance deviation (%) |
|---|---|---|
| Example 10 | 5 | 5 |
| Compar. Example 2 | 25 | 25 |

[Example 11]

Surface conduction electron-emitting devices having a configuration as shown in FIGS. 1A and 1B were prepared by way of the following steps.

Step-a through Step-d: Exactly same as those of Example 1.

Step-e: A 0.01 g of powdery silver oxide ($Ag_2O$) was added to a dispersed solution of tin oxide ($SnO_2$: 1 g. methylethylketone/cyclohexhane=1/3, solvent 1,000 cc, butyral: 1 g) to form a mixture, subjected to a spinner-coating operation and then heat-treated to produce a film of fine particles of tin oxide and silver oxide. Thereafter, a thin film for forming an electron-emitting region was prepared from said film of fine particles by lifting off the Cr film 24.

A pressurizable electric furnace was used for the heat-treatment, which was conducted at 200° C. and in an $O_2$ atmosphere having 3 atms. The reason for pressurization is that the equilibrium oxygen pressure of the mixture gas of $Ag_2O$ and $O_2$ exceeds 1 atm at 190° C. and, therefore, $Ag_2O$ decomposes in an $O_2$ atmosphere with 1 atm.

Step-f: The device was set in position in the apparatus of FIG. 13 and, after injecting $N_2$ gas into the reaction tank 38, it was scanned by a laser spot coming from a light source 42 of Ar ion laser as in the case of Example 4 over the entire surface of the thin film for forming an electron-emitting region except a central area with a width of 2 $\mu$m between the device electrodes. The laser power was 4 mW and the scanning speed was 10 $\mu$m/sec, or twice as fast as that of Example 4. With this process, the fine particles of $Ag_2O$ in the area of thin film irradiated with laser were pyrolyzed to produce fine particles of Ag and the electric resistance of that area was reduced. In other words, the area that had not been irradiated with a laser beam became a region for making an electron-emitting region in this example. This step can be carried out in the atmosphere by either raising the laser power or reducing the scanning speed.

Step-g: The device was subjected to an energization forming process as in Step-g of Example 1.

Step-h: The device was heated in $N_2$ at 200° C. for 10 minutes to reduce the remaining $Ag_2O$ in the thin film for forming an electron-emitting region. This process can be carried out in the atmosphere if heated to 300° C.

Step-i: The device was subjected to an activation process as in Step-h of Example 1.

Like the specimen devices of Example 1, those of this example showed a small swerve and operated effectively when tested with an arrangement described in Example 1.

While pyrolysis and reduction of $Ag_2O$ were used in this example, Step-f of this example can alternatively be carried out by irradiating $Ag_2O$ with weak light for a long period because it gradually decomposes at room temperature if exposed to light.

[Example 12]

Surface conduction electron-emitting devices having a configuration as shown in FIGS. 1A and 1B were prepared by way of the following steps.

Step-a through Step-d: Exactly same as those of Example 1.

Step-e: Fine particles of indium oxide ($In_2O_3$, particle size: 2–20 nm) and those of iron (Fe, particle size: 3–15 nm) were alternately used for forming a thin film of a mixture of $In_2O_3$ fine particles and Fe fine particles by means of gas deposition, although the former constituted the main component of the film. Thereafter, a thin film for forming an electron-emitting region made of the above mixture was prepared at a desired position by lifting off the Cr film 24.

Step-f: The device was set in position in the apparatus of FIG. 13 and, after producing an oxidizing atmosphere in the reaction tank 38, it was scanned by a laser beam only in a central area between the device electrodes. As a result of this process, the fine Fe particles of the area irradiated with laser of the mixture film were oxidized to become $\alpha$-$Fe_2O_3$ (hematite) and produce a region for making an electron-emitting region with a high electric resistance.

Step-g: The device was then subjected to energization forming and activation processes as Step-g and Step-h of Example 1.

[Example 13]

Surface conduction electron-emitting devices having a configuration as shown in FIGS. 1A and 1B were prepared by way of the following steps.

Step-a through Step-e: Exactly same as those of Example 1.

Step-f: The device electrodes of each device were connected to a pulse generator and an ammeter and a pulse voltage was applied to the electrodes. A triangular pulse wave with an incrementally increasing wave height as shown in FIG. 3B was used. The pulse interval and the pulse width were respectively 10 msec. and 100 $\mu$sec. A rectangular pulse voltage with a wave height of 0.1V was inserted in the interval to detect the electric resistance.

This process was conducted in the atmosphere. The resistance was initially equal to 100Ω and substantially remained at this level. However, a rise in the resistance was observed when the wave height of the triangular wave voltage was raised to 3.5V and, therefore, the voltage was held to the level of 3.5V for 1 minute thereafter. The resistance continued to rise until it got to about 150Ω, when the application of the pulse voltage was stopped.

Then, one of the devices was observed through a field emission type scanning electron microscope (FE-SEM) at the electroconductive thin film to find a linearly contoured area of fine particles with a width of about 2 $\mu$m at a central portion thereof. When examined by means of a Raman spectroscopic analyzer, a signal telling that PdO had been formed in a central area of the thin film was detected. For the detecting operation, Ar ion laser with a wavelength of 514.5 nm was used for the light source and the specimen was scanned with a laser spot having a diameter of 1 $\mu$m.

The reason for the formation of PdO may be that the electroconductive thin film generated Joule's heat as a pulse voltage was applied thereto and the generated heat was dispersed through the substrate and the device electrodes to raise most remarkably the temperature of the central area that was remotest from the device electrodes and oxidize the palladium there.

Thereafter, the devices were subjected to a process of energization forming, applying a pulse voltage same as the one used in Step-g of Example 1, and subsequently held in a $N_2$-2% $H_2$ gas flow for 1 hour as in the case of Step-h of Example to reduce PdO to Pd. Then, an activation process was carried out on them, placing them in a gauging system as shown in FIG. 4. When Ie of each device reached a saturated level, the luminance of the fluorescent body arranged at the anode was observed to obtain a result similar to that of Example 1.

In the above operation, the devices were placed in a simple container, where a $N_2$-2% $H_2$ mixture gas could be introduced, from Step-d to the step of reducing PdO to Pd. Since the flow rate of the mixture gas did not have to be rigorously controlled, it was regulated simply by adjusting the valve of a regulator fitted to the gas container. No specific hydrogen gas remover was needed because the hydrogen gas concentration was sufficiently low and there was no danger of explosion.

When observed again though a FE-SEM, the swerve of the electron-emitting region was generally found within 1 $\mu$m.

Like the specimen devices of Example 1, those of this example showed a small swerve and operated effectively when tested with an arrangement described in Example 1.

[Example 14]

In this example, an image-forming apparatus of FIG. 7 was prepared, using an electron source shown in FIG. 6 and realized by arranging a number of surface conduction electron-emitting devices of FIGS. 1A and 1B to a simple matrix arrangement.

Figure 17A:
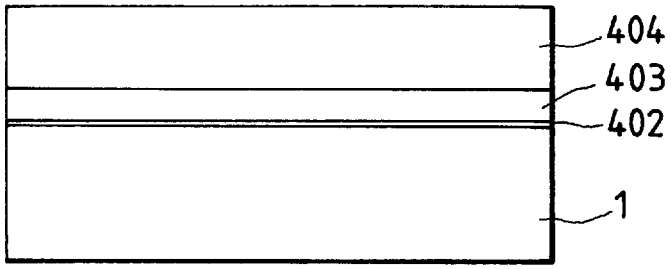
FIGS. 17AA through 17AD are schematic views of the electron source of Example 13 in different manufacturing steps.
Figure 17A:
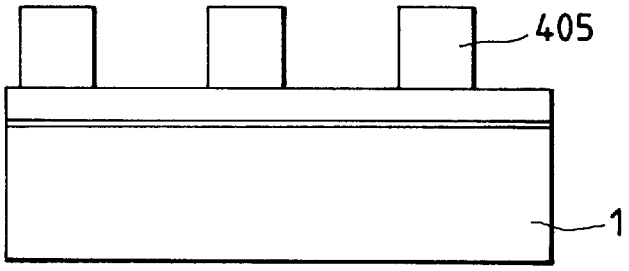
Figure 17A:
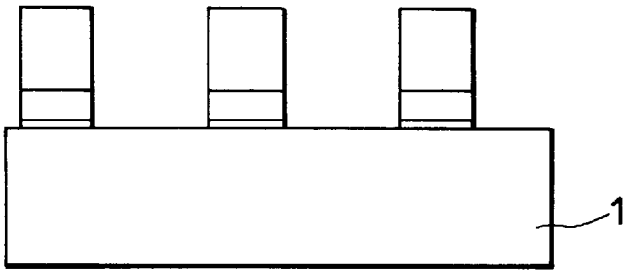
Figure 17A:
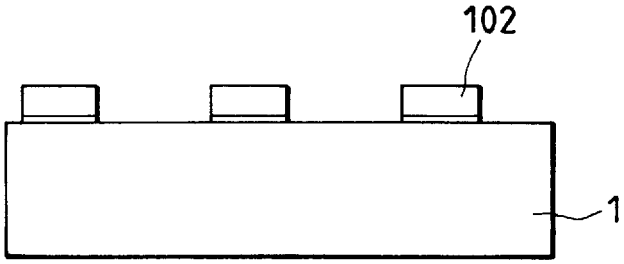

Firstly, the method employed to prepare the electron source of this example will be described by referring to FIGS. 17AA through 20K.

(1) After thoroughly cleansing a soda lime glass plate 1, a Cr film 402 and an Au film 403 were sequentially formed on it to thicknesses of 5 nm and 600 nm respectively by vacuum deposition, on which photoresist (AZ1370: available from Hoechst) 404 was applied, while rotating the substrate, by means of a spinner and then baked. Thereafter, a photomask image was exposed and photochemically developed to produce a resist pattern 405 for lower wires 102 (FIGS. 17AA through 17AD).

Figure 18B:
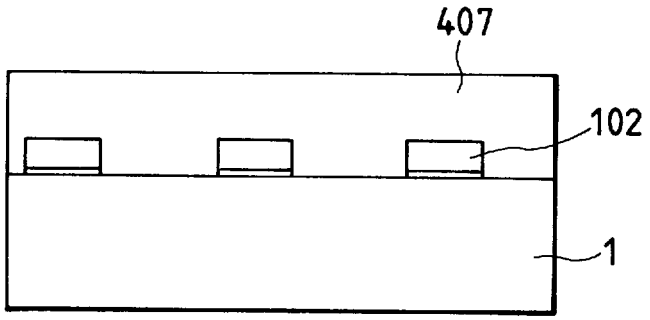
FIGS. 18B through 18E are schematic views of the electron source of Example 13 in still different manufacturing steps.

(2) An interlayer insulation layer 407 of silicon oxide film was deposited to a thickness of 0.1 $\mu$m by high frequency sputtering (FIG. 18B).

Figure 18C:
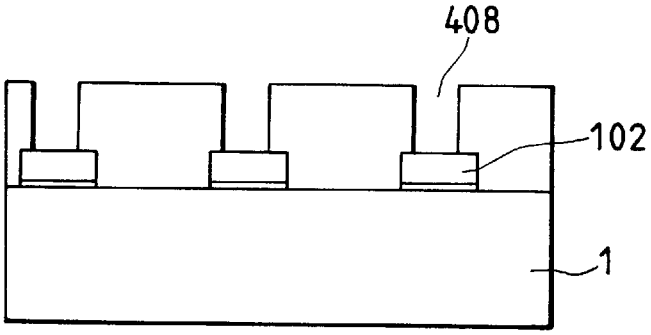

(3) Subsequently, a photoresist pattern was formed on the silicon oxide film to produce contact holes and, using the resist pattern as a mask, contact holes 408 were actually prepared by RIE (Reactive Ion Etching) (FIG. 18C). $CF_4$ and $H_2$ were used as etching gas.

Figure 18D:
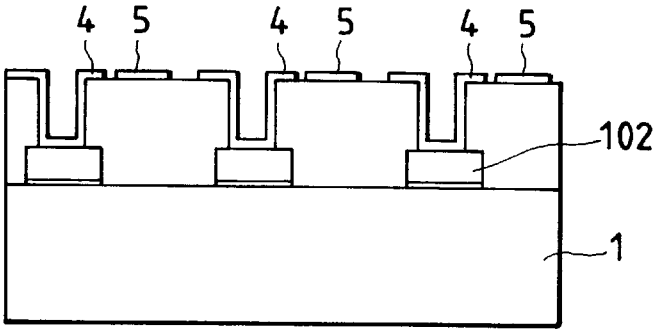

(4) Thereafter, a pattern of photoresist (RD-2000N-41: available from Hitachi Chemical Co., Ltd.) was prepared for the device electrodes 4, 5 and Ti and Ni were sequentially deposited to respective thicknesses of 5 nm and 100 nm by vacuum deposition. Then, the photoresist pattern was dissolved into an organic solvent and the Ni/Ti layers were lifted off to produce a pair of device electrodes 4, 5 (FIG. 18D). The gap between the device electrodes was 50 $\mu$m.

Figure 18E:
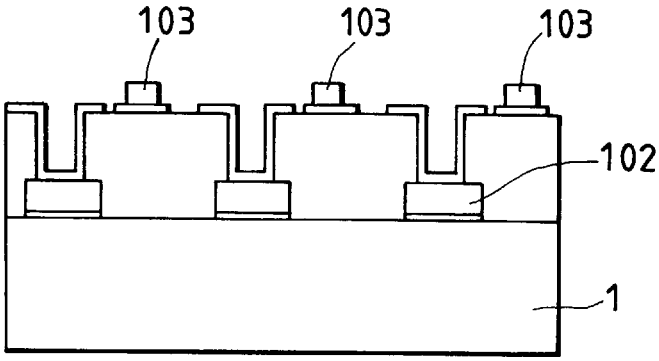

(5) Then, a photoresist patter was prepared for the upper wires and Ti and Au were sequentially deposited to respective thicknesses of 5 nm and 100 nm by vacuum deposition. Then, any unnecessary areas of the photoresist were removed by means of a lift-off technique to produce upper wires 103 (FIG. 18E).

Figure 19F:
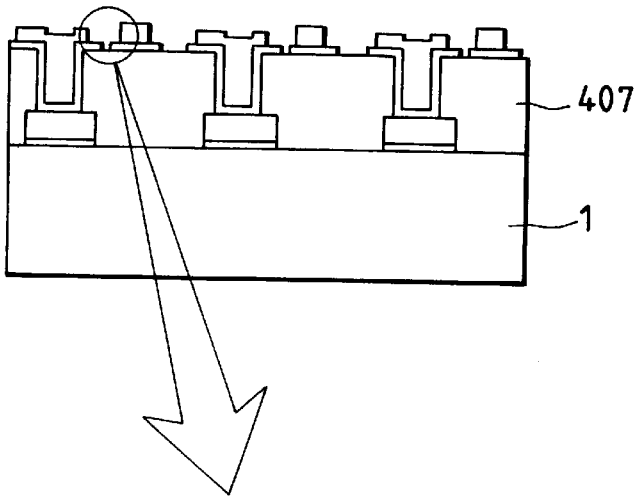
FIGS. 19F through 19H are schematic views of the electron source of Example 13 in still different manufacturing steps.

(6) Subsequently, a resist film was formed to cover the areas other than those of the contact holes 408 by vacuum deposition and Ti and Au were sequentially deposited to respective thicknesses of 5 nm and 500 nm by vacuum deposition to bury the contact holes 408 when any unnecessary areas of the films were lifted off (FIG. 19F).

Figure 19G:
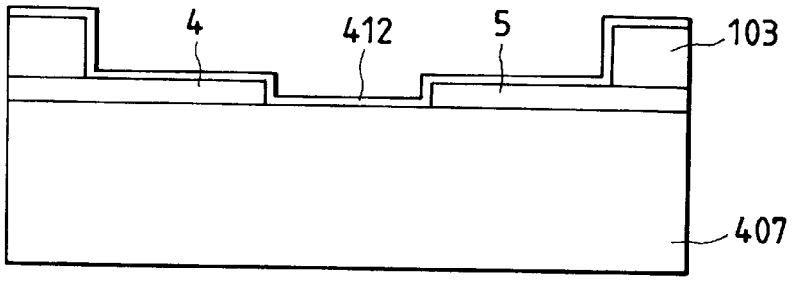

(7) A Cr film 412 was formed over the entire surface of the device by sputtering (FIG. 19G).

Figure 19H:
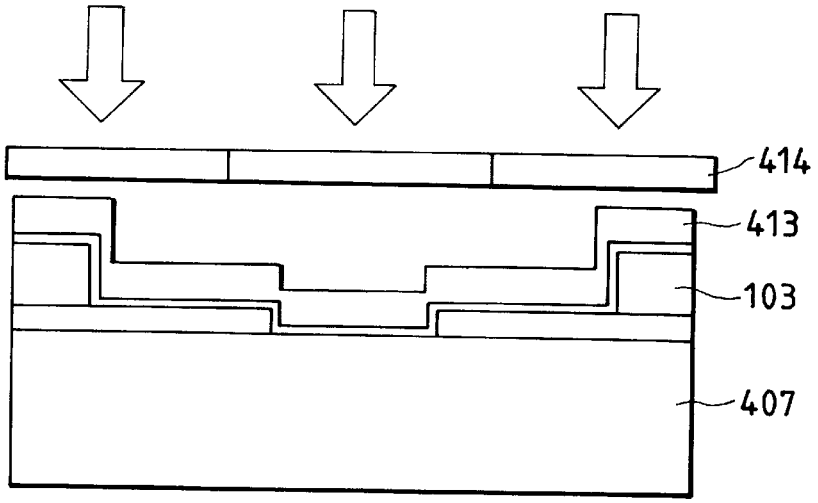

(8) After applying resist 413 to the entire surface of the device, the pattern of the thin film 7 for forming an electron-emitting region was exposed to light (FIG. 19H). Note that the thin film 7 eventually made the electroconductive thin film 3 of the device.

Figure 20I:
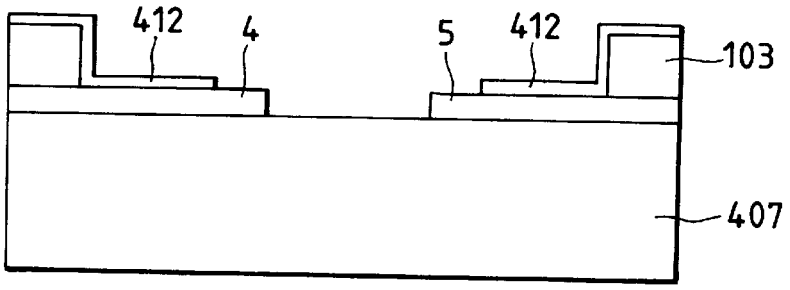
FIGS. 20I through 20K are schematic views of the electron source of Example 13 in still different manufacturing steps.

(9) After chemically developing the exposed pattern, any unnecessary areas of the Cr film 412 were etched out and the remaining resist was removed to produce a pattern of Cr film 412 (FIG. 20I).

Figure 20J:
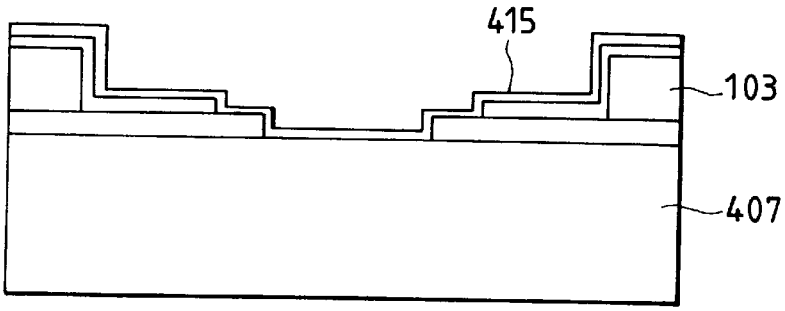

(10) Thereafter, a solution of organic Pd complex (ccp-4230: available from Okuno Pharmaceutical Co., Ltd.) was applied to the Cr film by means of a spinner and baked at 300° C. for 12 minutes to produce a PdO film. This operation was repeated to obtain a PdO film 415 of a desired film thickness (FIG. 20J).

Figure 20K:
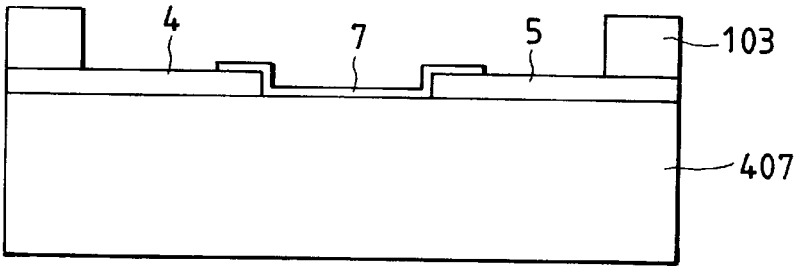

(11) Any unnecessary PdO was removed with the Cr film 412 by lifting it off to obtain a thin film 7 for forming an electron-emitting region extending between the device electrodes 4, 5 and having a desired profile (FIG. 20K). The thin film 7 for forming an electron-emitting region had a width of 300 $\mu$m.

The subsequent steps are not shown in the drawings.

Figure 13:
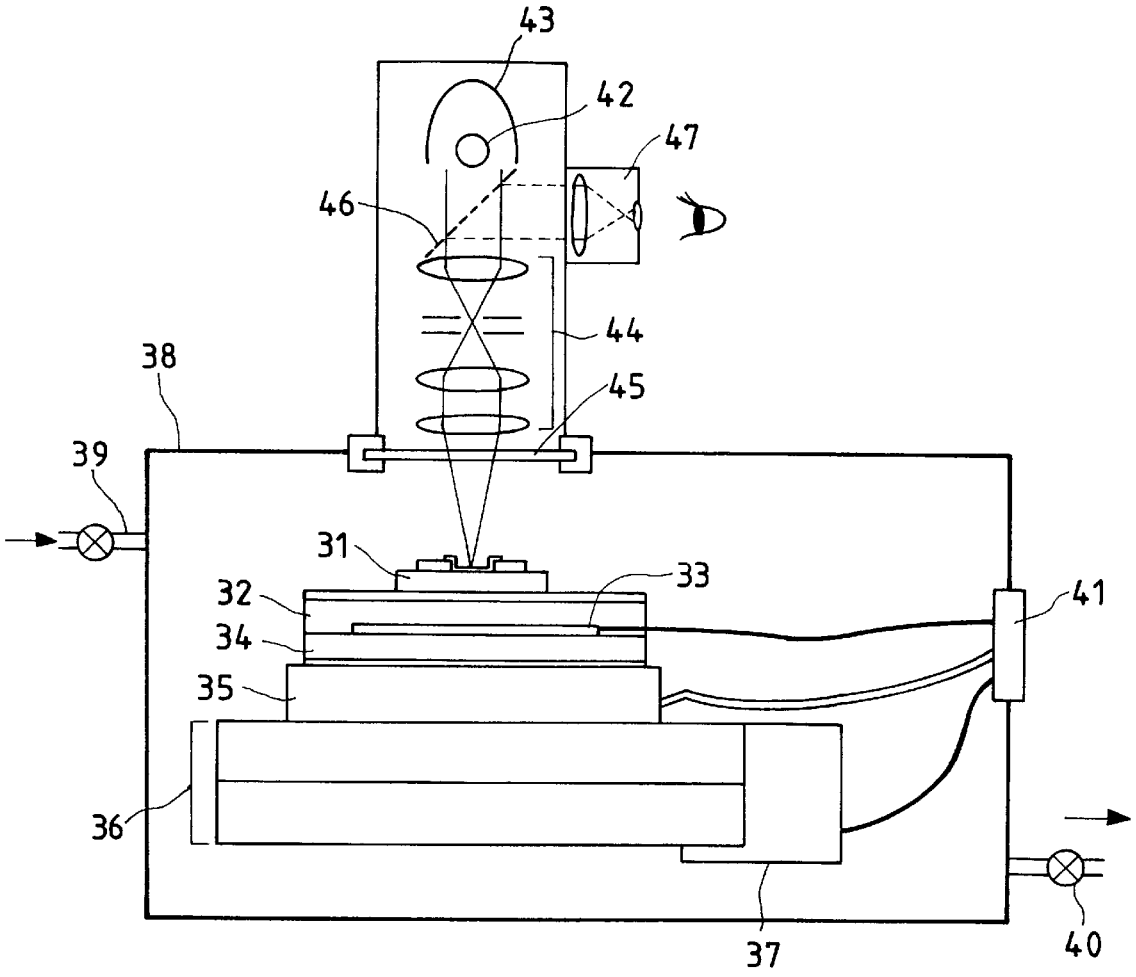
FIG. 13 is a schematic sectional view of a light irradiation apparatus used to prepare the surface conduction electron-emitting device of Example 1.

(12) The devices were set in position in the apparatus of FIG. 13 and a mixture gas of $N_2$-2% $H_2$ was injected into the reaction tank 38 for 1 hour to reduce the thin film 7 for forming an electron-emitting region to a film of Pd fine particles.

(13) The atmosphere in the reaction tank 38 was replaced by $O_2$ gas and a central area between the device electrodes 4, 5 was scanned by a laser spot of Ar ion laser under the conditions same as those of Example 4 to produce a region 6 for making an electron-emitting region made of PdO.

Figure 21:
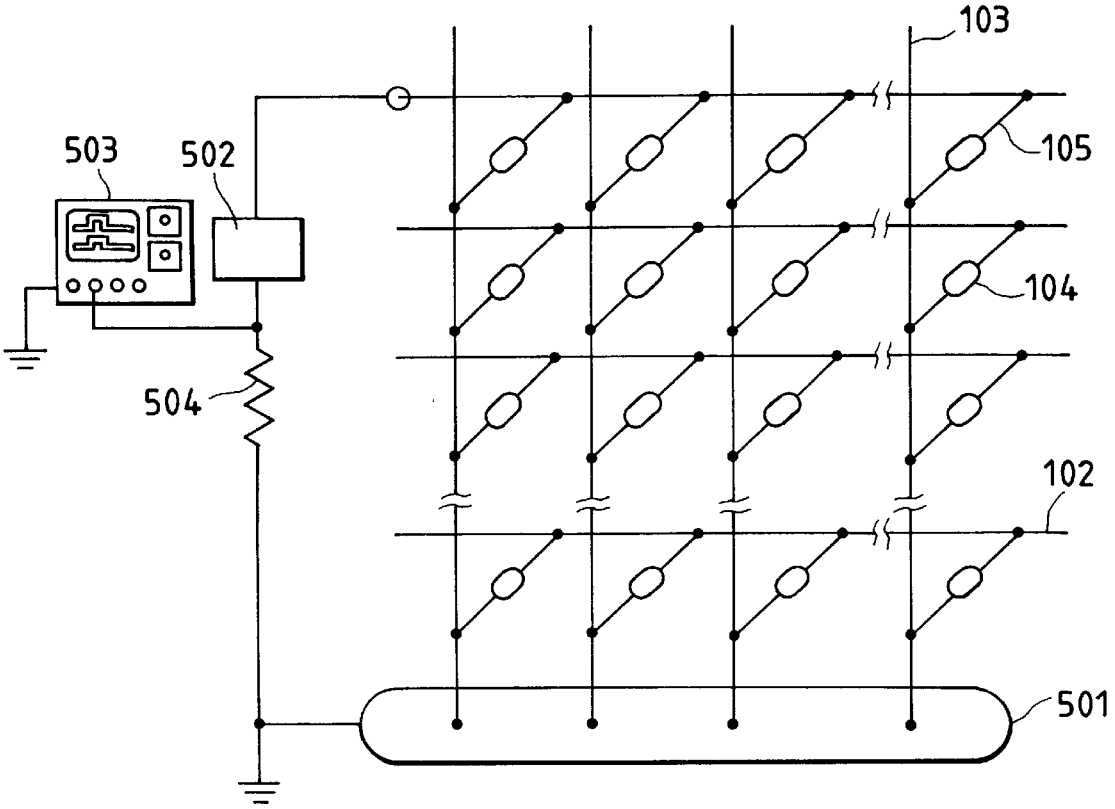
FIG. 21 is a schematic view of an electron source of Example 13, illustrating how it is wired for an energization forming process.
Figure 23:
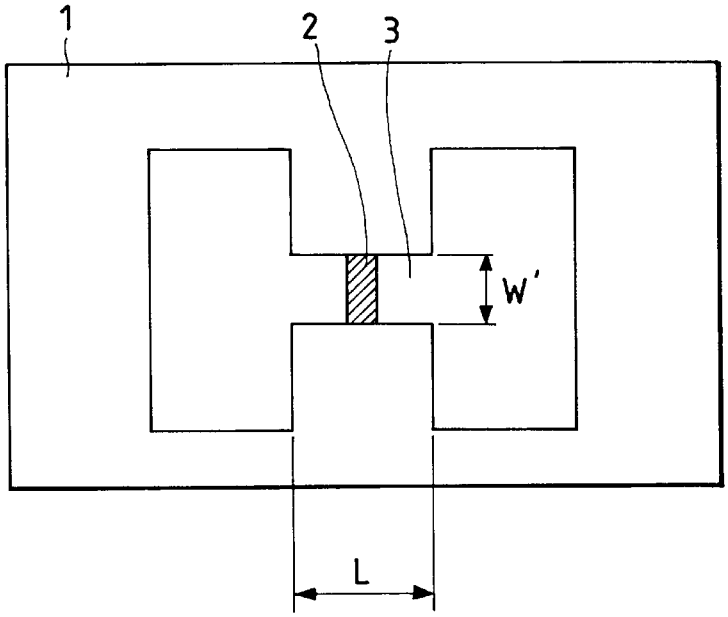
FIG. 23 is a schematic plan view of a known surface conduction electron-emitting device proposed by M. Hartwell.

(14) A number of devices, each comprising a pair of device electrodes 4, 5 and a thin film 7 for forming an electron-emitting region were arranged to a simple matrix arrangement to produce an electron source, which was subjected to an energization forming operation on a line by line basis along the X-direction, using an upper wires (Y-directional wires) 103 for connecting the devices of a same line as shown in FIG. 21, to produce electron-emitting regions 2 in the respective regions 6 for making electron-emitting regions. In FIG. 21, reference numeral 501 denotes a common electrode and reference numeral 502 denotes a pulse generator, while reference numerals 503 and 504 respectively denote an oscilloscope and a shunt resistor. A pulse wave voltage same as the one used in Example 1 was also used for this example.

Finally, an image-forming apparatus was prepared by using the above described electron source. The process of manufacturing the apparatus will be described below by referring to FIGS. 7, 8A and 8B.

After securing the substrate 1 of the electron source to a rear plate 111, a face plate 116 (consisting of a fluorescent film 114 for producing images and a metal back 115 arranged on the inner surface of a glass substrate 113) was mounted 5 mm above the substrate 1 with a support frame 112 disposed therebetween. Frit glass was applied to the junctions of the face plate 116, the support frame 112, the rear plate 111 and baked at 410° C. for 10 minutes in the atmosphere to securely bonding them together. The rear plate 111 was also secured to the substrate 1 with frit glass.

The fluorescent film 114 for producing images was composed of striped fluorescent bodies (FIG. 8A) for color display. It was prepared by arranging black stripes in the first place and applying fluorescent substances of three primary colors to the gaps between the strips to produce the fluorescent film 114 to form fluorescent bodies 122. The black stripes were made of a material containing graphite as a principal ingredient.

A metal back 115 was arranged on the inner surface of the fluorescent film 114. The metal back 115 was prepared by smoothing (in an operation referred to as "filming") the inner surface of the fluorescent film 114 and depositing Al thereon by vacuum deposition.

While the face plate 116 may be provided with a transparent electrode (not shown) on the outer surface side of the fluorescent film 114 in order to enhance the electroconductivity of the fluorescent film 114, no such electrode was arranged for this example because the metal back 115 showed a sufficient electroconductivity.

Before hermetically sealing the envelope 118 of the image-forming apparatus consisting of the above listed components, the fluorescent bodies 122 of three primary colors had to be accurately aligned with the corresponding surface conduction electron-emitting devices 104.

Then, a mixture gas of $N_2$-2% $H_2$ was injected into the closure 118 to reduce the PdO of the thin film 7 for forming an electron-emitting region to a film of Pd.

Thereafter, the envelope 118 was evacuated through an exhaust pipe (not shown) by means of a vacuum pump to produce a degree of vacuum of $1\times10^{-3}$ Pa in the inside and subjected to an activation process on a line by line basis as in the case of energization forming. A rectangular pulse wave with a pulse wave height of 14V, a pulse width of 100 $\mu$m and a pulse interval of 10 msec. was used.

Subsequently, the envelope 118 was further evacuated via the exhaust pipe (not shown) to achieve a degree of vacuum of about $1\times10^{4}$ Torr and then the exhaust pipe was sealed by heating and melting it with a gas burner to hermetically seal the envelope 118. Finally, the display panel was subjected to a getter operation on by means of high frequency heating in order to maintain the inside to a high degree of vacuum. The getter contained Ba as a principal ingredient.

In order to drive the display panel 201 (FIG. 7) of the image-forming apparatus, scan signals and modulation signals were applied to the electron-emitting devices 104 to emit electrons from respective signal generation means (not shown) by way of the external terminals Dx1 through Dxm and Dy1 through Dyn, while a high voltage of greater than 5 kV was applied to the metal back 115 or a transparent electrode (not shown) by way of the high voltage terminal Hv so that electrons emitted from the cold cathode devices were accelerated by the high voltage and collided with the fluorescent film 114 to cause the fluorescent members to excite and emit light to produce fine images of the quality of high definition television, which were free from the problem of uneven brightness.

[Example 15]

Figure 22:
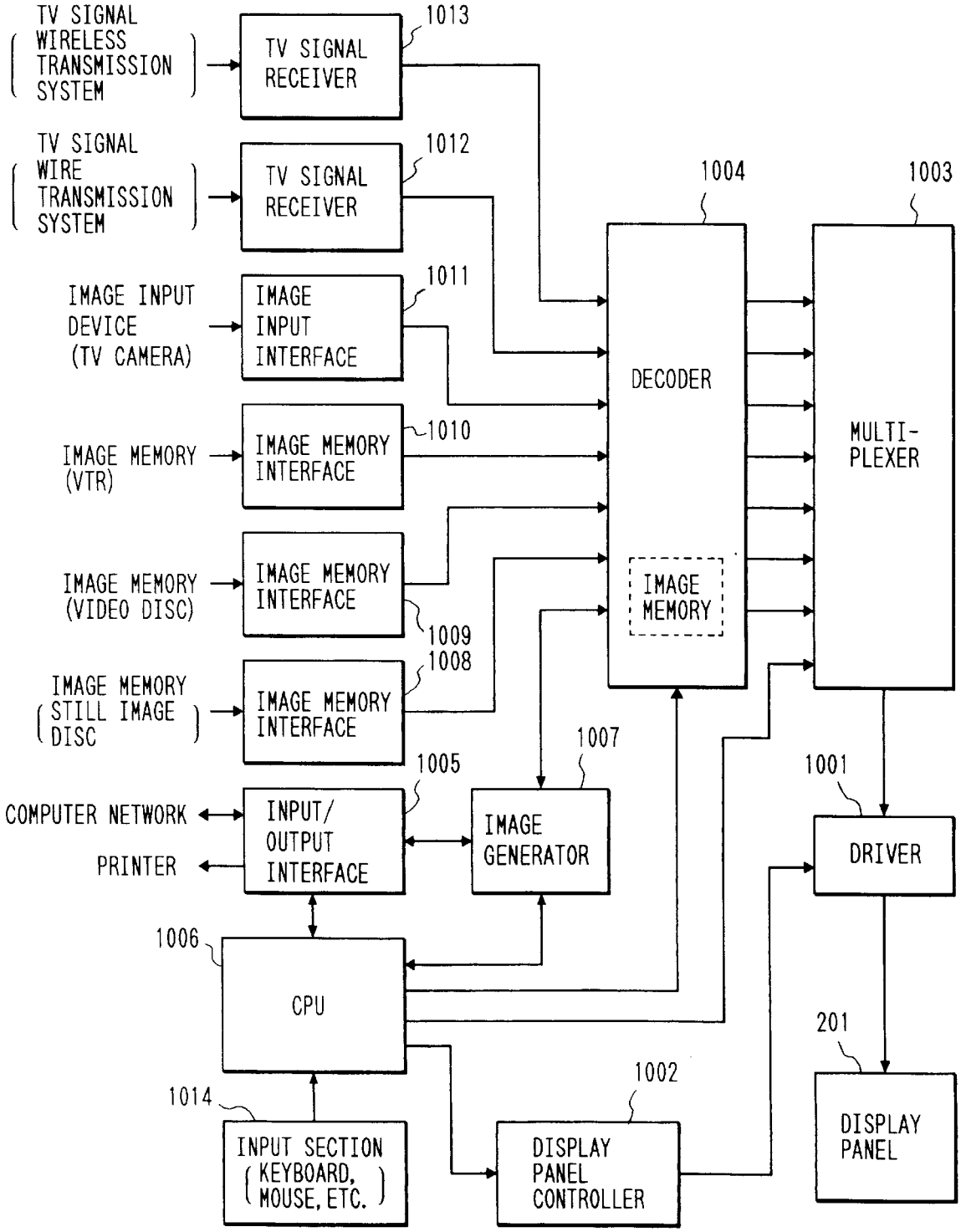
FIG. 22 is a schematic block diagram of an image-forming apparatus of Example 15.

FIG. 22 is a block diagram of a display apparatus realized by using a method according to the invention and a display panel prepared in Example 13 (FIG. 7) and arranged to provide visual information coming from a variety of sources of information including television transmission and other image sources.

In FIG. 22, there are shown a display panel 201, a display panel driver 1001, a display panel controller 1002, a multiplexer 1003, a decoder 1004, an input/output interface 1005, a CPU 1006, an image generator 1007, image input memory interfaces 1008, 1009 and 1010, an image input interface 1011, TV signal receivers 1012 and 1013 and an input unit 1014.

If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.

Now, the components of the apparatus will be described, following the flow of image signals therethrough.

Firstly, the TV signal receiver 1013 is a circuit for receiving TV image signals transmitted via a wireless transmission system using electromagnetic waves and/or spatial optical telecommunication networks.

The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel 201 comprising a large number of pixels.

The TV signals received by the TV signal receiver are forwarded to the decoder 1004.

The TV signal receiver 1012 is a circuit for receiving TV image signals transmitted via a wired transmission system using coaxial cables and/or optical fibers. Like the TV signal receiver 1013, the TV signal system to be used is not limited to a particular one and the TV signals received by the circuit are forwarded to the decoder 1004.

The image input interface 1011 is a circuit for receiving image signals forwarded from an image input device such as a TV camera or an image pick-up scanner. It also forwards the received image signals to the decoder 1004.

The image input memory interface 1010 is a circuit for retrieving image signals stored in a video tape recorder (hereinafter referred to as VTR) and the retrieved image signals are also forwarded to the decoder 1004.

The image input memory interface 1009 is a circuit for retrieving image signals stored in a video disc and the retrieved image signals are also forwarded to the decoder 1004.

The image input memory interface 1008 is a circuit for retrieving image signals stored in a device for storing still image data such as so-called still disc and the retrieved image signals are also forwarded to the decoder 1004.

The input/output interface 1005 is a circuit for connecting the display apparatus and an external output signal source such as a computer, a computer network or a printer. It carries out input/output operations for image data and data on characters and graphics and, if appropriate, for control signals and numerical data between the CPU 1006 of the display apparatus and an external output signal source.

The image generation circuit 1007 is a circuit for generating image data to be displayed on the display screen on the basis of the image data and the data on characters and graphics input from an external output signal source via the input/output interface 1005 or those coming from the CPU 1006. The circuit comprises reloadable memories for storing image data and data on characters and graphics, read-only memories for storing image patterns corresponding given character codes, a processor for processing image data and other circuit components necessary for the generation of screen images.

Image data generated by the image generation circuit 1007 for display are sent to the decoder 1004 and, if appropriate, they may also be sent to an external circuit such as a computer network or a printer via the input/output interface 1005.

The CPU 1006 controls the display apparatus and carries out the operation of generating, selecting and editing images to be displayed on the display screen.

For example, the CPU 1006 sends control signals to the multiplexer 1003 and appropriately selects or combines signals for images to be displayed on the display screen. At the same time it generates control signals for the display panel controller 1002 and controls the operation of the display apparatus in terms of image display frequency, scanning method (e.g., interlaced scanning or non-interlaced scanning), the number of scanning lines per frame and so on. The CPU 1006 also sends out image data and data on characters and graphic directly to the image generation circuit 1007 and accesses external computers and memories via the input/output interface 1005 to obtain external image data and data on characters and graphics.

The CPU 1006 may additionally be so designed as to participate other operations of the display apparatus including the operation of generating and processing data like the CPU of a personal computer or a word processor. The CPU 1006 may also be connected to an external computer network via the input/output interface 1005 to carry out computations and other operations, cooperating therewith.

The input unit 1014 is used for forwarding the instructions, programs and data given to it by the operator to the CPU 1006. As a matter of fact, it may be selected from a variety of input devices such as keyboards, mice, joysticks, bar code readers and voice recognition devices as well as any combinations thereof.

The decoder 1004 is a circuit for converting various image signals input via said circuits 1007 through 1003 back into signals for three primary colors, luminance signals and I and Q signals. Preferably, the decoder 1004 comprises image memories as indicated by a dotted line in FIG. 22 for dealing with television signals such as those of the MUSE system that require image memories for signal conversion.

The provision of image memories additionally facilitates the display of still images as well as such operations as thinning out, interpolating, enlarging, reducing, synthesizing and editing frames to be optionally carried out by the decoder 1004 in cooperation with the image generation circuit 1007 and the CPU 1006.

The multiplexer 1003 is used to appropriately select images to be displayed on the display screen according to control signals given by the CPU 1006. In other words, the multiplexer 1003 selects certain converted image signals coming from the decoder 1004 and sends them to the drive circuit 1001. It can also divide the display screen in a plurality of frames to display different images simultaneously by switching from a set of image signals to a different set of image signals within the time period for displaying a single frame.

The display panel controller 1002 is a circuit for controlling the operation of the drive circuit 1001 according to control signals transmitted from the CPU 1006.

Among others, it operates to transmit signals to the drive circuit 1001 for controlling the sequence of operations of the power source (not shown) for driving the display panel in order to define the basic operation of the display panel 190. It also transmits signals to the drive circuit 1001 for controlling the image display frequency and the scanning method (e.g., interlaced scanning or non-interlaced scanning) in order to define the mode of driving the display panel 190. If appropriate, it also transmits signals to the drive circuit 1001 for controlling the quality of the images to be displayed on the display screen in terms of luminance, contrast, color tone and sharpness.

The drive circuit 1001 is a circuit for generating drive signals to be applied to the display panel 190. It operates according to image signals coming from said multiplexer 1003 and control signals coming from the display panel controller 1002.

A display apparatus according to the invention and having a configuration as described above and illustrated in FIG. 22 can display on the display panel 201 various images given from a variety of image data sources. More specifically, image signals such as television image signals are converted back by the decoder 1004 and then selected by the multiplexer 1003 before sent to the drive circuit 1001. On the other hand, the display controller 1002 generates control signals for controlling the operation of the drive circuit 1001 according to the image signals for the images to be displayed on the display panel 201. The drive circuit 1001 then applies drive signals to the display panel 201 according to the image signals and the control signals. Thus, images are displayed on the display panel 201. All the above described operations are controlled by the CPU 1006 in a coordinated manner.

The above described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 1004, the image generation circuit 1007 and the CPU 1006 participate such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 22 shows only an example of possible configuration of a display apparatus comprising a display panel provided with an electron source prepared by arranging a number of surface conduction electron-emitting devices and the present invention is not limited thereto.

For example, some of the circuit components of FIG. 22 that are not necessary for a particular application may be omitted. To the contrary, additional components may be arranged there depending on the application. For example, if a display apparatus according to the invention is used for visual telephone, it may be appropriately made to comprise additional components such as a television camera, a microphone, lighting equipment and transmission/reception circuits including a modem.

Since an image-forming apparatus according to the invention can be made very flat because the electron source itself comprising surface conduction electron-emitting devices does not require a large depth. In addition, the display panel can be made very large and have an enhanced brightness and a wide viewing angle to make it possible to display lively vivid images.

As described above in detail, according to the invention, a region for making an electron-emitting region showing a high electric resistance is formed in advance in a portion of a thin film for forming an electron-emitting region of an electron-emitting device so that an electron-emitting device can be formed in said region for making an electron-emitting region by subjecting the device to a subsequent energization forming operation. With such an arrangement, the electron-emitting region can be rigorously controlled for its position and profile to produce devices that operate uniformly.

Thus, there can be provided a large electron source comprising a large number of electron-emitting devices capable of operating uniformly for electron emission and an image-forming apparatus incorporating such an electron source can display quality images because the electron-emitting regions of the devices are free from the problem of swerved profile that can give rise to diverged electron beams.

Thus, according to the invention, a large and flat display apparatus that displays finely defined color images can be provided.

What is claimed is:

1. A method of manufacturing an electron source comprising the steps of:

providing a plurality of electron-emitting devices arranged on a substrate, each of the plurality of electron-emitting devices having an electroconductive thin film formed between a pair of device electrodes; and forming an electron-emitting region in the electroconductive thin film of each of the plurality of electron-emitting devices by performing the steps of:

partially modifying the composition of of the electroconductive thin film with a chemical change to make a region of the electroconductive thin film have a higher resistivity than a resistivity of other regions; and causing an electric current to run through the electroconductive thin film to form the electron-emitting region in the region having the higher resistivity.

2. A method of manufacturing an electron source according to claim 1, wherein said electron-emitting devices are surface conduction electron-emitting devices.

3. A method of manufacturing an image-forming apparatus comprising the steps of:

providing an electron source having a plurality of electron-emitting devices arranged on a substrate, each of the plurality of electron-emitting devices having an electroconductive thin film between a pair of electrodes;

forming an electron-emitting region in the electroconductive thin film of each of the plurality of electron-emitting devices by performing the steps of:

partially modifying the composition of the electroconductive thin film with a chemical change to make a region of the electroconductive thin film have a higher resistivity than a resistivity of other regions; and causing an electric current to run through the electroconductive thin film to form the electron-emitting region in the region having the higher resistivity.

4. A method of manufacturing an image-forming apparatus according to claim 3, wherein said electron-emitting devices are surface conduction electron-emitting devices.

5. A method of manufacturing an image-forming apparatus according to claim 3, wherein said image-forming member is fluorescent bodies.

6. A method of manufacturing an image-forming apparatus according to claim 4, wherein said image-forming member is fluorescent bodies.

7. A method of manufacturing an electron-emitting device comprising the steps of:

providing a pair of electrodes and an electroconductive thin film arranged between the electrodes; and forming an electron-emitting region in the electroconductive thin film by performing the steps of:

partially modifying the composition of the electroconductive thin film with a chemical change to make a region of the electroconductive thin film have a higher resistivity than a resistivity in other regions; and causing an electric current to run through said electroconductive thin film to form the electron-emitting region in the region having the higher resistivity.

8. A method of manufacturing an electron-emitting device according to claim 7, wherein said step of partially modifying the composition of the electroconductive thin film is a step of forming a region of a metal and another region of an oxide of the metal in the electroconductive thin film.

9. A method of manufacturing an electron-emitting device according to claim 7, wherein said step of partially modifying the composition of the electroconductive thin film includes a step of forming a region of a mixture of a metal and a semiconductor and another region of a mixture of an oxide of the metal and the semiconductor.

10. A method of manufacturing an electron-emitting device according to claim 7, wherein said step of partially modifying the composition of the electroconductive thin film includes a step of forming a region of a metal and another region of a nitride of the metal.

11. A method of manufacturing an electron-emitting device according to claim 7, wherein said step of partially modifying the composition of the electroconductive thin film includes a step of nitriding part of a region of a metal in the electroconductive thin film.

12. A method of manufacturing an electron-emitting device according to claim 11, wherein said step of nitriding part of a region of a metal in the electroconductive thin film includes a step of heating part of a region of a metal in the electroconductive thin film.

13. A method of manufacturing an electron-emitting device according to claim 7, wherein said step of partially modifying the composition of the electroconductive thin film includes a step of forming a region of a metal and another region of an oxide in a film made of an organic metal compound.

14. A method of manufacturing an electron-emitting device according to claim 13, wherein said step of forming a region of a metal and another region of an oxide of the metal in a film made of an organic metal compound includes a step of keeping the film made of an organic metal compound in one of atmosphere and oxygen, and keeping the film at a temperature above a temperature at which the organic metal compound turns to metal and below a temperature at which the organic metal compound turns to a metal oxide, and irradiating the region of an organic metal compound with ultraviolet beams.

15. A method of manufacturing an electron-emitting device according to claim 7, wherein said step of partially modifying the composition of the electroconductive thin film includes a step of oxidizing part of a region of a mixture of a metal and a semiconductor in the electroconductive thin film.

16. A method of manufacturing an electron-emitting device according to claim 15, wherein said step of oxidizing part of a region of a mixture of a metal and a semiconductor in the electroconductive thin film includes a step of heating part of a region of a mixture of a metal and a semiconductor in the electroconductive thin film at an oxidizing temperature.

17. A method of manufacturing an electron-emitting device according to claim 7, wherein said step of partially modifying the composition of the electroconductive thin film includes a step of reducing part of a region of a mixture of a metal oxide and a semiconductor in the electroconductive thin film.

18. A method of manufacturing an electron-emitting device according to claim 17, wherein said step of reducing part of a region of a mixture of a metal oxide and a semiconductor in the electroconductive thin film includes a step of heating part of a region of a mixture of a metal oxide and a semiconductor in the electroconductive thin film.

19. A method of manufacturing an electron-emitting device according to claim 7, wherein said step of partially modifying the composition of the electroconductive thin film includes a step of reducing part of a region of a metal oxide in the electroconductive thin film.

20. A method of manufacturing an electron-emitting device according to claim 19, wherein said step of reducing part of a region of a metal oxide of the electroconductive thin film includes a step of irradiating part of a region of a metal oxide of electroconductive thin film with electron beams.

21. A method of manufacturing an electron-emitting device according to claim 19, wherein said step of reducing part of a region of a metal oxide of the electroconductive thin film includes a step of irradiating part of a metal oxide of electroconductive thin film with light in one of an inert gas and a reducing gas.

22. A method of manufacturing an electron-emitting device according to claim 7, wherein said step of partially modifying the composition of the electroconductive thin film includes a step of oxidizing part of a region of a metal in the electroconductive thin film.

23. A method of manufacturing an electron-emitting device according to claim 22, wherein said step of oxidizing part of a region of a metal in the electroconductive thin film includes a step of heating part of a region of a metal in an oxidizing atmosphere.

24. A method of manufacturing an electron-emitting device according to claim 23, wherein said heating step includes a step of irradiating said electroconductive thin film with light.

25. A method of manufacturing an electron-emitting device according to claim 23, wherein said heating step includes a step of causing an electric current to flow through the electroconductive thin film.

26. A method of manufacturing an electron-emitting device according to any of claims 7 through 12, wherein said electron-emitting device is a surface conduction electron-emitting device.

* * * * *

UNITED STATES PATENT AND TRADEMARK OFFICE

CERTIFICATE OF CORRECTION

PATENT NO. : 5,853,310

DATED : December 29, 1998

INVENTOR(S) : Michiyo Nishimura, et al.

It is certified that error appears in the above-identified patent and that said Letters Patent is hereby corrected as shown below:

Column 35, lines 26 and 27, delete "said image-forming member is fluorescent bodies" and insert --said image-forming apparatus has fluorescent bodies as an image-forming member--.

Column 35, lines 29 and 30, delete "said image-forming member is fluorescent bodies" and insert --said image-forming apparatus has fluorescent bodies as an image-forming member--.

Signed and Sealed this

Thirteenth Day of April, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,853,310

DATED : December 29, 1998

INVENTOR(S) : MICHIYO NISHIMURA, ET AL.

It is certified that error appears in the above-identified patent and that said Letters Patent is hereby corrected as shown below:

COLUMN 1

Line 15, "devices;" should read --devices:--.

COLUMN 4

Line 34, "where" should read --which--.

COLUMN 7

Line 14, "The." should read --The--.

COLUMN 8

Line 6, "particles" should read --particle--.

UNITED STATES PATENT AND TRADEMARK OFFICE

CERTIFICATE OF CORRECTION

PATENT NO. : 5,853,310

DATED : December 29, 1998

INVENTOR(S) : MICHIYO NISHIMURA, ET AL.

It is certified that error appears in the above-identified patent and that said Letters Patent is hereby corrected as shown below:

COLUMN 15

Line 30, "be" should be deleted.

COLUMN 19

Line 19, "devices,104" should read --devices 104--.

COLUMN 20

Line 2, "can" should be deleted.

UNITED STATES PATENT AND TRADEMARK OFFICE

CERTIFICATE OF CORRECTION

PATENT NO. : 5,853,310

DATED : December 29, 1998

INVENTOR(S) : MICHIYO NISHIMURA, ET AL.

It is certified that error appears in the above-identified patent and that said Letters Patent is hereby corrected as shown below:

COLUMN 24

Line 24, "a" should read --the--.

COLUMN 25

Line 7, "was" should read --were--.

COLUMN 29

Line 67, "an" should be deleted.

UNITED STATES PATENT AND TRADEMARK OFFICE

CERTIFICATE OF CORRECTION

PATENT NO. : 5,853,310

DATED : December 29, 1998

INVENTOR(S) : MICHIYO NISHIMURA, ET AL.

It is certified that error appears in the above-identified patent and that said Letters Patent is hereby corrected as shown below:

COLUMN 35

Line 25, "image-forming mem-" should read --image-forming apparatus has fluorescent bodies as an image-forming member--;

Line 26, "ber is fluorescent bodies" should be deleted;

Line 29, "image-forming mem-" should read --image-forming apparatus has fluorescent bodies as an image-forming member--; and Line 30, "ber is fluorescent bodies" should be deleted.

Signed and Sealed this

Tenth Day of October, 2000

*Attest:*

*Attesting Officer*

Q. TODD DICKINSON

*Director of Patents and Trademarks*